US009236058B2

(12) United States Patent
Subasingha et al.

(10) Patent No.: US 9,236,058 B2
(45) Date of Patent: Jan. 12, 2016

(54) SYSTEMS AND METHODS FOR QUANTIZING AND DEQUANTIZING PHASE INFORMATION

(71) Applicant: QUALCOMM Incorporated, San Diego, CA (US)

(72) Inventors: Subasingha Shaminda Subasingha, San Diego, CA (US); Venkatesh Krishnan, San Diego, CA (US); Vivek Rajendran, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 256 days.

(21) Appl. No.: 14/015,991

(22) Filed: Aug. 30, 2013

(65) Prior Publication Data

US 2014/0236584 A1 Aug. 21, 2014

Related U.S. Application Data

(60) Provisional application No. 61/767,455, filed on Feb. 21, 2013.

(51) Int. Cl.
*G10L 19/02* (2013.01)
*G10L 19/032* (2013.01)
*G10L 19/097* (2013.01)

(52) U.S. Cl.
CPC ..... *G10L 19/032* (2013.01); *G10L 19/02* (2013.01); *G10L 19/097* (2013.01)

(58) Field of Classification Search
CPC ..... G10L 25/90; G10L 19/0212; G10L 19/04; G10L 19/10; G10L 19/12; G10L 19/24; G10L 19/038; G10L 19/093; G10L 19/18; G10L 19/20; G10L 2025/937; G10L 25/27; G10L 25/93; G10L 19/097; G10L 19/02; G10L 19/032; H04M 2201/52; H04M 7/006; H04M 2201/40; H04M 2203/2027; H04M 2203/2066; H04M 3/002; H04M 3/2209; H04M 3/2272; H04M 7/0069; H04M 7/125; H04M 11/062; H04Q 1/45; Y02B 60/31
USPC ..... 704/208, 230, 214, 221, 207, 201, 205, 704/215, 217, 219, 220, 226, 246, 265; 370/352, 526, 286, 280, 401, 516, 370/230.1; 375/345, 388.03, 283
See application file for complete search history.

(56) References Cited

U.S. PATENT DOCUMENTS 5,001,758 A * 3/1991 Galand et al. ..... 704/212
5,765,127 A * 6/1998 Nishiguchi et al. ..... 704/208

(Continued)

FOREIGN PATENT DOCUMENTS

EP 2346030 A1 7/2011
TW 201246060 A 11/2012

OTHER PUBLICATIONS

Taiwan Search Report—TW103101042—TIPO—Mar. 6, 2015.

(Continued)

*Primary Examiner* — Vijay B Chawan
(74) *Attorney, Agent, or Firm* — Austin Rapp & Hardman

(57) ABSTRACT

A method for quantizing phase information on an electronic device is described. The method includes obtaining a speech signal. The method also includes determining a prototype pitch period signal based on the speech signal and transforming the prototype pitch period signal into a first frequency-domain signal. The method additionally includes mapping the first frequency-domain signal into a plurality of subbands. The method also includes determining a global alignment based on the first frequency-domain signal and quantizing the global alignment utilizing scalar quantization to obtain a quantized global alignment. The method additionally includes determining a plurality of band alignments corresponding to the plurality of subbands. The method also includes quantizing the plurality of band alignments utilizing vector quantization to obtain a quantized plurality of band alignments. The method further includes transmitting the quantized global alignment and the quantized plurality of band alignments.

44 Claims, 18 Drawing Sheets

(56) References Cited

U.S. PATENT DOCUMENTS

| | | | | |
|---|---|---|---|---|
| 5,884,253 | A | 3/1999 | Kleijn | |
| 6,219,635 | B1 | 4/2001 | Coulter et al. | |
| 6,272,460 | B1 | 8/2001 | Wu et al. | |
| 6,377,916 | B1 * | 4/2002 | Hardwick | 704/208 |
| 7,039,581 | B1 * | 5/2006 | Stachurski et al. | 704/205 |
| 7,139,700 | B1 * | 11/2006 | Stachurski et al. | 704/207 |
| 7,222,070 | B1 * | 5/2007 | Stachurski et al. | 704/207 |
| 7,272,556 | B1 * | 9/2007 | Aguilar et al. | 704/230 |
| 7,924,752 | B2 * | 4/2011 | Tackin et al. | 370/286 |
| 2004/0002856 | A1 | 1/2004 | Bhaskar et al. | |
| 2006/0020469 | A1 | 1/2006 | Rast | |
| 2008/0027711 | A1 * | 1/2008 | Rajendran et al. | 704/201 |
| 2008/0052068 | A1 * | 2/2008 | Aguilar et al. | 704/230 |
| 2009/0112580 | A1 | 4/2009 | Hirabayashi et al. | |

OTHER PUBLICATIONS

3GPP2 Presentation Selectable Mode Vocoder A Collaboration between QUALCOMM,Motorola, and Lucent Technologies, 3GPP2 Draft; C11-2000-04-25-011QML SMV Presentation, 3rd Generation Partnership Project 2, 3GPP2, 2500 Wilson Boulevard, Suite 300, Arlington, Virginia 22201 ; USA vol. TSGC Apr. 18, 2005, pp. 1-44, XP062133266, Retrieved from the Internet: URL:http://ftp.3gpp2.org/TSGC/Working/2000 /TSG-C 0004/2000_04 TSG-C Seattle/TSG-C1.1/ [retrieved on Apr. 18, 2005] slide 17.

"Enhanced Variable Rate Codec, Speech Service Options 3, 68, 70, and 73 for Wideband Spread Spectrum Digital Systems".. , 3GPP2 Draft; C.S0014-D, 3rd Generation Partnership Project 2, 3GPP2, 2590 Wilson Boulevard, Suite 399, Arlington, Virginia 22291 . USA, vol. TSGC, no. Version 1.0, May 14, 2009, pp. 1-398, XP062171871, Retrieved from the Internet: URL:http://ftp.3gpp2.org/TSGC/Working/2009/2009-95-Vancouver/TSG-C-2009-05-Vancouver /WG1/09_95_97_Telecon/ [retrieved-on-May 14, 2000].

International Search Report and Written Opinion—PCT/US2013/057871, International Search Authority—European Patent Office, Feb. 11, 2014.

* cited by examiner

SYSTEMS AND METHODS FOR QUANTIZING AND DEQUANTIZING PHASE INFORMATION

RELATED APPLICATIONS

This application is related to and claims priority to U.S. Provisional Patent Application Ser. No. 61/767,455, filed Feb. 21, 2013, for "SYSTEMS AND METHODS FOR PERFORMING A BAND ALIGNMENT SEARCH."

TECHNICAL FIELD

The present disclosure relates generally to electronic devices. More specifically, the present disclosure relates to systems and methods for quantizing phase information.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges arise in encoding, transmitting and decoding of audio signals. For example, an audio signal may be encoded in order to reduce the amount of bandwidth required to transmit the audio signal. Inefficient encoding can utilize more bandwidth than is needed to accurately represent an audio signal. As can be observed from this discussion, systems and methods that improve encoding and decoding may be beneficial.

SUMMARY

A method for quantizing phase information on an electronic device is described. The method includes obtaining a speech signal. The method also includes determining a prototype pitch period signal based on the speech signal. The method further includes transforming the prototype pitch period signal into a first frequency-domain signal. The method additionally includes mapping the first frequency-domain signal into a plurality of subbands. The method also includes determining a global alignment based on the first frequency-domain signal. The method further includes quantizing the global alignment utilizing scalar quantization to obtain a quantized global alignment. The method additionally includes determining a plurality of band alignments corresponding to the plurality of subbands. The method also includes quantizing the plurality of band alignments utilizing vector quantization to obtain a quantized plurality of band alignments. The method further includes transmitting the quantized global alignment and the quantized plurality of band alignments. Transforming the prototype pitch period signal may include determining a discrete-time Fourier series of the prototype pitch period signal or performing a discrete Fourier transform on the prototype pitch period signal. Mapping the first frequency-domain signal may be based on a length of the first frequency-domain signal.

The method may include determining an amplitude for each of the plurality of subbands. The method may also include determining a second frequency-domain signal based on an amplitude-quantized prototype pitch period signal. A length of the second frequency-domain signal may be equal to a length of the first frequency-domain signal. Determining the global alignment may be based on a correlation between the first frequency-domain signal and the second frequency-domain signal.

Determining the amplitude for each of the plurality of subbands may include determining an average amplitude of at least one frequency index of the first frequency-domain signal within at least one of the plurality of subbands. The average amplitude of a subband with two or more frequency indices may be an average amplitude of first and last frequency indices in the subband.

Determining the plurality of band alignments corresponding to the plurality of subbands may include determining a band alignment based on a correlation between a portion of the first frequency-domain signal and a portion of a globally shifted frequency-domain signal.

Determining the plurality of band alignments may include sequentially shifting at least one of the portion of the first frequency-domain signal and the portion of the globally shifted frequency-domain signal. The sequential shifting may be performed within a single rotation around a unit circle. A shift resolution may be higher for a higher subband. The plurality of subbands may include one or more subbands with non-uniform bandwidths.

An electronic device for quantizing phase information is also described. The electronic device includes prototype pitch period extraction circuitry that determines a prototype pitch period signal based on a speech signal. The electronic device also includes frequency domain transform circuitry coupled to the prototype pitch period extraction circuitry. The frequency domain transform circuitry transforms the prototype pitch period signal into a first frequency-domain signal. The electronic device further includes amplitude transform circuitry coupled to the frequency domain transform circuitry. The amplitude transform circuitry maps the first frequency-domain signal into a plurality of subbands. The electronic device additionally includes global alignment search circuitry coupled to the frequency domain transform circuitry. The global alignment search circuitry determines a global alignment based on the first frequency-domain signal. The electronic device also includes band alignment search circuitry coupled to the global alignment search circuitry. The band alignment search circuitry determines a plurality of band alignments corresponding to the plurality of subbands. The electronic device further includes global alignment quantizer circuitry coupled to the global alignment search circuitry. The global alignment quantizer circuitry quantizes the global alignment utilizing scalar quantization to obtain a quantized global alignment. The electronic device additionally includes band alignments quantizer circuitry coupled to the band alignment search circuitry. The band alignments quantizer circuitry quantizes the plurality of band alignments utilizing vector quantization to obtain a quantized plurality of band alignments. The electronic device also includes transmitter circuitry that transmits the quantized global alignment and the quantized plurality of band alignments.

A computer-program product for quantizing phase information is also described. The computer-program product includes a non-transitory tangible computer-readable medium with instructions. The instructions include code for causing an electronic device to obtain a speech signal. The instructions also include code for causing the electronic device to determine a prototype pitch period signal based on the speech signal. The instructions further include code for causing the electronic device to transform the prototype pitch period signal into a first frequency-domain signal. The instructions additionally include code for causing the electronic device to map the first frequency-domain signal into a plurality of subbands. The instructions also include code for causing the electronic device to determine a global alignment based on the first frequency-domain signal. The instructions further include code for causing the electronic device to quantize the global alignment utilizing scalar quantization to obtain a quantized global alignment. The instructions additionally include code for causing the electronic device to determine a plurality of band alignments corresponding to the plurality of subbands. The instructions also include code for causing the electronic device to quantize the plurality of band alignments utilizing vector quantization to obtain a quantized plurality of band alignments. The instructions further include code for causing the electronic device to transmit the quantized global alignment and the quantized plurality of band alignments.

An apparatus for quantizing phase information is also described. The apparatus includes means for obtaining a speech signal. The apparatus also includes means for determining a prototype pitch period signal based on the speech signal. The apparatus further includes means for transforming the prototype pitch period signal into a first frequency-domain signal. The apparatus additionally includes means for mapping the first frequency-domain signal into a plurality of subbands. The apparatus also includes means for determining a global alignment based on the first frequency-domain signal. The apparatus further includes means for quantizing the global alignment utilizing scalar quantization to obtain a quantized global alignment. The apparatus additionally includes means for determining a plurality of band alignments corresponding to the plurality of subbands. The apparatus also includes means for quantizing the plurality of band alignments utilizing vector quantization to obtain a quantized plurality of band alignments. The apparatus further includes means for transmitting the quantized global alignment and the quantized plurality of band alignments.

DETAILED DESCRIPTION

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
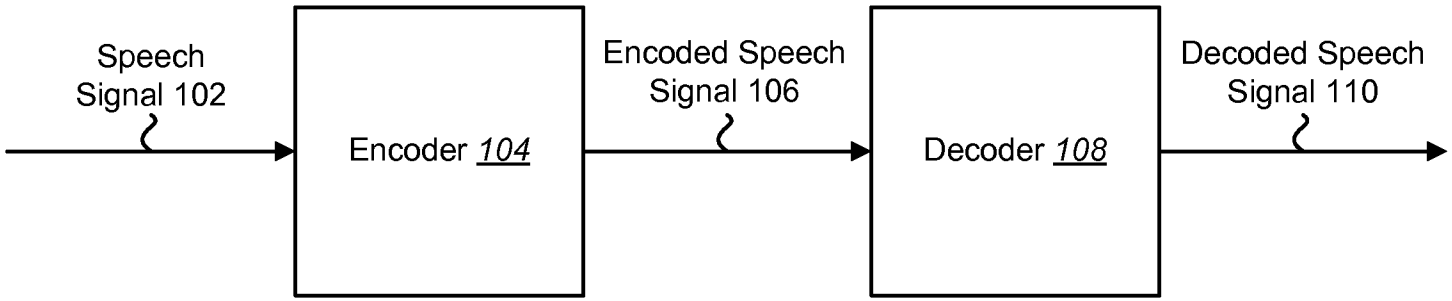
FIG. 1 is a block diagram illustrating a general example of an encoder and a decoder.

FIG. 1 is a block diagram illustrating a general example of an encoder 104 and a decoder 108. The encoder 104 receives a speech signal 102. The speech signal 102 may be a speech signal in any frequency range. For example, the speech signal 102 may be a full band signal with an approximate frequency range of 0-24 kilohertz (kHz), superwideband signal with an approximate frequency range of 0-16 kilohertz (kHz), a wideband signal with an approximate frequency range of 0-8 kHz, a narrowband signal with an approximate frequency range of 0-4 kHz, a lowband signal with an approximate frequency range of 50-300 hertz (Hz) or a highband signal with an approximate frequency range of 4-8 kHz. Other possible frequency ranges for the speech signal 102 include 300-3400 Hz (e.g., the frequency range of the Public Switched Telephone Network (PSTN)), 14-20 kHz, 16-20 kHz and 16-32 kHz. In some configurations, the speech signal 102 may be sampled at 16 kHz and may have an approximate frequency range of 0-8 kHz.

The encoder 104 encodes the speech signal 102 to produce an encoded speech signal 106. In general, the encoded speech signal 106 includes one or more parameters that represent the speech signal 102. One or more of the parameters may be quantized. Examples of the one or more parameters include filter parameters (e.g., weighting factors, line spectral frequencies (LSFs), line spectral pairs (LSPs), immittance spectral frequencies (ISFs), immittance spectral pairs (ISPs), partial correlation (PARCOR) coefficients, reflection coefficients and/or log-area-ratio values, etc.) and parameters included in an encoded excitation signal (e.g., quantized amplitude, quantized global alignment, quantized band alignments, pitch, etc.). The parameters may correspond to one or more frequency bands. The decoder 108 decodes the encoded speech signal 106 to produce a decoded speech signal 110. For example, the decoder 108 constructs the decoded speech signal 110 based on the one or more parameters included in the encoded speech signal 106. The decoded speech signal 110 may be an approximate reproduction of the original speech signal 102.

The encoder 104 may be implemented in hardware (e.g., circuitry), software or a combination of both. For example, the encoder 104 may be implemented as an application-specific integrated circuit (ASIC) or as a processor with instructions. Similarly, the decoder 108 may be implemented in hardware (e.g., circuitry), software or a combination of both. For example, the decoder 108 may be implemented as an application-specific integrated circuit (ASIC) or as a processor with instructions. The encoder 104 and the decoder 108 may be implemented on separate electronic devices or on the same electronic device.

In some configurations, the encoder 104 and/or decoder 108 may be included in a speech coding system where speech synthesis is done by passing an excitation signal through a synthesis filter to generate a synthesized speech output (e.g., the decoded speech signal 110). In such a system, an encoder 104 receives the speech signal 102, then windows the speech signal 102 to frames (e.g., 20 millisecond (ms) frames) and generates synthesis filter parameters and parameters required to generate the corresponding excitation signal. These parameters may be transmitted to the decoder as an encoded speech signal 106. The decoder 108 may use these parameters to generate a synthesis filter (e.g., 1/A(z)) and the corresponding excitation signal and may pass the excitation signal through the synthesis filter to generate the decoded speech signal 110. FIG. 1 may be a simplified block diagram of such a speech encoder/decoder system.

Figure 2:
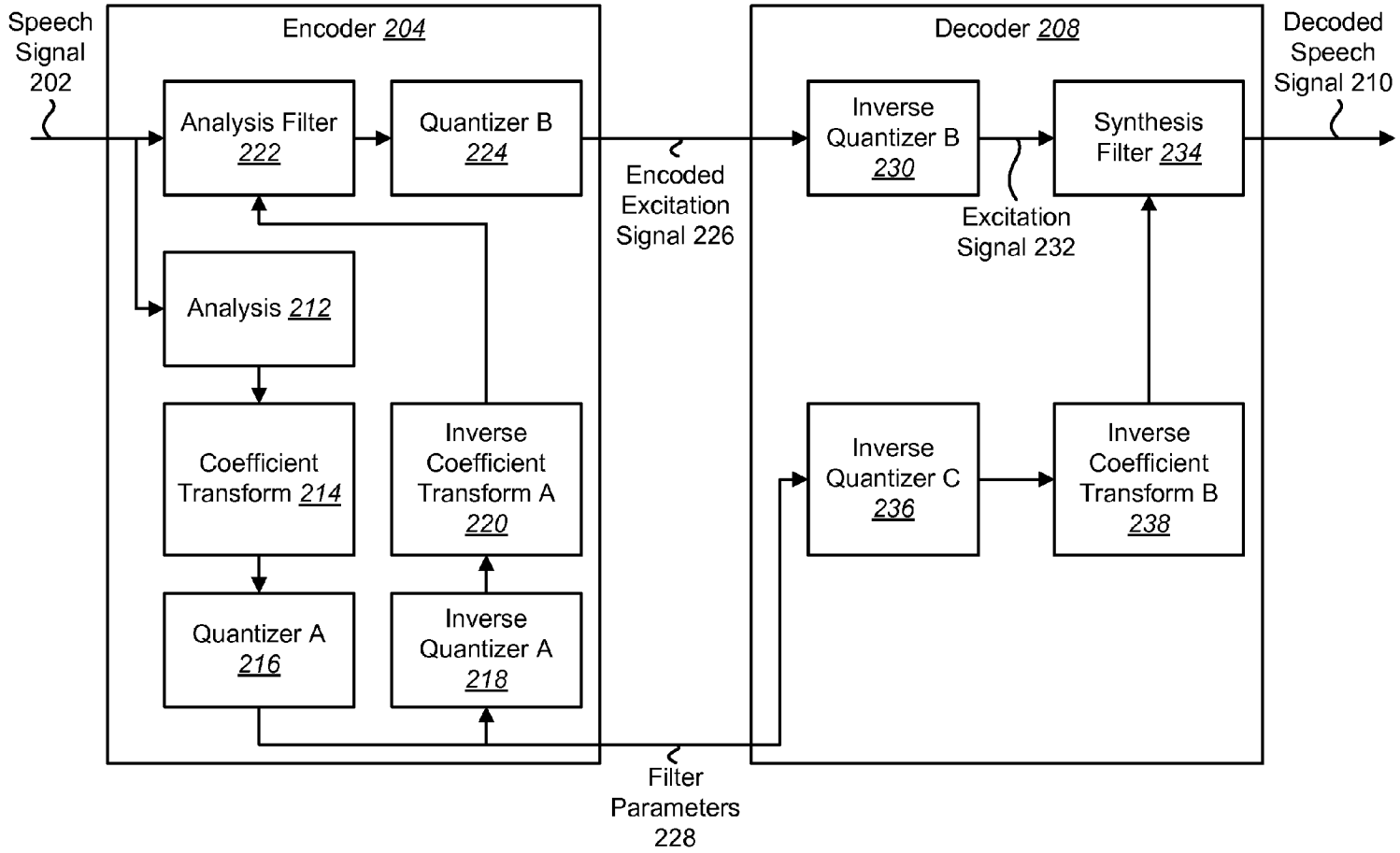
FIG. 2 is a block diagram illustrating an example of a basic implementation of an encoder and a decoder.

FIG. 2 is a block diagram illustrating an example of a basic implementation of an encoder 204 and a decoder 208. The encoder 204 may be one example of the encoder 104 described in connection with FIG. 1. The encoder 204 may include an analysis module 212, a coefficient transform 214, quantizer A 216, inverse quantizer A 218, inverse coefficient transform A 220, an analysis filter 222 and quantizer B 224. One or more of the components of the encoder 204 and/or decoder 208 may be implemented in hardware (e.g., circuitry), software or a combination of both.

The encoder 204 receives a speech signal 202. It should be noted that the speech signal 202 may include any frequency range as described above in connection with FIG. 1 (e.g., an entire band of speech frequencies or a subband of speech frequencies).

In this example, the analysis module 212 encodes the spectral envelope of a speech signal 202 as a set of linear prediction (LP) coefficients (e.g., analysis filter coefficients A(z), which may be applied to produce an all-pole synthesis filter 1/A(z), where z is a complex number. The analysis module 212 typically processes the input signal as a series of non-overlapping frames of the speech signal 202, with a new set of coefficients being calculated for each frame or subframe. In some configurations, the frame period may be a period over which the speech signal 202 may be expected to be locally stationary. One common example of the frame period is 20 ms (equivalent to 160 samples at a sampling rate of 8 kHz, for example). In one example, the analysis module 212 is configured to calculate a set of ten linear prediction coefficients to characterize the formant structure of each 20-ms frame. It is also possible to implement the analysis module 212 to process the speech signal 202 as a series of overlapping frames.

The analysis module 212 may be configured to analyze the samples of each frame directly, or the samples may be weighted first according to a windowing function (e.g., a Hamming window). The analysis may also be performed over a window that is larger than the frame, such as a 30-ms window. This window may be symmetric (e.g., 5-20-5, such that it includes the 5 milliseconds immediately before and after the 20-ms frame) or asymmetric (e.g., 10-20, such that it includes the last 10 ms of the preceding frame). The analysis module 212 is typically configured to calculate the linear prediction coefficients using a Levinson-Durbin recursion or the Leroux-Gueguen algorithm. In another implementation, the analysis module may be configured to calculate a set of cepstral coefficients for each frame instead of a set of linear prediction coefficients.

The output rate of the encoder 204 may be reduced significantly, with relatively little effect on reproduction quality, by quantizing the coefficients. Linear prediction coefficients are difficult to quantize efficiently and are usually mapped into another representation, such as LSFs for quantization and/or entropy encoding. In the example of FIG. 2, the coefficient transform 214 transforms the set of coefficients into a corresponding LSF vector (e.g., set of LSFs). Other one-to-one representations of coefficients include LSPs, PARCOR coefficients, reflection coefficients, log-area-ratio values, ISPs and ISFs. For example, ISFs may be used in the GSM (Global System for Mobile Communications) AMR-WB (Adaptive Multirate-Wideband) codec. For convenience, the term "line spectral frequencies," "LSFs," "LSF vectors" and related terms may be used to refer to one or more of LSFs, LSPs, ISFs, ISPs, PARCOR coefficients, reflection coefficients and log-area-ratio values. Typically, a transform between a set of coefficients and a corresponding LSF vector is reversible, but some configurations may include implementations of the encoder 204 in which the transform is not reversible without error.

Quantizer A 216 is configured to quantize the LSF vector (or other coefficient representation). The encoder 204 may output the result of this quantization as filter parameters 228. Quantizer A 216 typically includes a vector quantizer that encodes the input vector (e.g., the LSF vector) as an index to a corresponding vector entry in a table or codebook.

As seen in FIG. 2, the encoder 204 also generates a residual signal by passing the speech signal 202 through an analysis filter 222 (also called a whitening or prediction error filter) that is configured according to the set of coefficients. The analysis filter 222 may be implemented as a finite impulse response (FIR) filter or an infinite impulse response (IIR) filter. This residual signal will typically contain perceptually important information of the speech frame, such as long-term structure relating to pitch, that is not represented in the filter parameters 228. Quantizer B 224 is configured to calculate a quantized representation of this residual signal for output as an encoded excitation signal 226. In some configurations, quantizer B 224 includes a vector quantizer that encodes the input vector as an index to a corresponding vector entry in a table or codebook. Additionally or alternatively, quantizer B 224 may be configured to send one or more parameters from which the vector may be generated dynamically at the decoder, rather than retrieved from storage, as in a sparse codebook method. Such a method is used in coding schemes such as algebraic CELP (code-excited linear prediction) and codecs such as 3GPP2 (Third Generation Partnership 2) EVRC (Enhanced Variable Rate Codec). In some configurations, the encoded excitation signal 226 and the filter parameters 228 may be included in an encoded speech signal 106.

It may be beneficial for the encoder 204 to generate the encoded excitation signal 226 according to the same filter parameter values that will be available to the corresponding decoder 208. In this manner, the resulting encoded excitation signal 226 may already account to some extent for non-idealities in those parameter values, such as quantization error. Accordingly, it may be beneficial to configure the analysis filter 222 using the same coefficient values that will be available at the decoder 208. In the basic example of the encoder 204 as illustrated in FIG. 2, inverse quantizer A 218 dequantizes the filter parameters 228. Inverse coefficient transform A 220 maps the resulting values back to a corresponding set of coefficients. This set of coefficients is used to configure the analysis filter 222 to generate the residual signal that is quantized by quantizer B 224.

Some implementations of the encoder 204 are configured to calculate the encoded excitation signal 226 by identifying one among a set of codebook vectors that best matches the residual signal. It is noted, however, that the encoder 204 may also be implemented to calculate a quantized representation of the residual signal without actually generating the residual signal. For example, the encoder 204 may be configured to use a number of codebook vectors to generate corresponding synthesized signals (according to a current set of filter parameters, for example) and to select the codebook vector associated with the generated signal that best matches the original speech signal 202 in a perceptually weighted domain.

The decoder 208 may include inverse quantizer B 230, inverse quantizer C 236, inverse coefficient transform B 238 and a synthesis filter 234. Inverse quantizer C 236 dequantizes the filter parameters 228 (an LSF vector, for example) and inverse coefficient transform B 238 transforms the LSF vector into a set of coefficients (for example, as described above with reference to inverse quantizer A 218 and inverse coefficient transform A 220 of the encoder 204). Inverse quantizer B 230 dequantizes the encoded excitation signal 226 to produce an excitation signal 232. Based on the coefficients and the excitation signal 232, the synthesis filter 234 synthesizes a decoded speech signal 210. In other words, the synthesis filter 234 is configured to spectrally shape the excitation signal 232 according to the dequantized coefficients to produce the decoded speech signal 210. In some configurations, the decoder 208 may also provide the excitation signal 232 to another decoder, which may use the excitation signal 232 to derive an excitation signal of another frequency band (e.g., a highband). In some implementations, the decoder 208 may be configured to provide additional information to another decoder that relates to the excitation signal 232, such as spectral tilt, pitch gain and lag and speech mode.

The system of the encoder 204 and the decoder 208 is a basic example of an analysis-by-synthesis speech codec. Codebook excitation linear prediction coding is one popular family of analysis-by-synthesis coding. Implementations of such coders may perform waveform encoding of the residual, including such operations as selection of entries from fixed and adaptive codebooks, error minimization operations and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse excitation (MPE), multi-pulse CELP (MP-CELP) and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10) (which uses residual excited linear prediction (RELP)), the GSM enhanced full rate codec (ETSI-GSM 06.60), the ITU (International Telecommunication Union) standard 11.8 kbps G.729 Annex E coder, the IS (Interim Standard)-641 codecs for IS-136 (a time-division multiple access scheme), the GSM adaptive multirate (GSM-AMR) codecs and the 4GV™ (Fourth-Generation Vocoder™) codec (QUALCOMM Incorporated, San Diego, Calif.). The encoder 204 and corresponding decoder 208 may be implemented according to any of these technologies, or any other speech coding technology (whether known or to be developed) that represents a speech signal as (A) a set of parameters that describe a filter and (B) an excitation signal used to drive the described filter to reproduce the speech signal.

Even after the analysis filter 222 has removed the coarse spectral envelope from the speech signal 202, a considerable amount of fine harmonic structure may remain, especially for voiced speech. Periodic structure is related to pitch, and different voiced sounds spoken by the same speaker may have different formant structures but similar pitch structures.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 hertz (Hz). This characteristic is typically encoded as the inverse of the fundamental frequency, also called the pitch lag. The pitch lag indicates the number of samples in one pitch period and may be encoded as one or more codebook indices. Speech signals from male speakers tend to have larger pitch lags than speech signals from female speakers.

The encoder 204 may include one or more modules configured to encode the long-term harmonic structure of the speech signal 202. In some approaches, the encoder 204 includes an open-loop LPC analysis module, which encodes the short-term characteristics or coarse spectral envelope. The short-term characteristics are encoded as coefficients (e.g., filter parameters). Other characteristics may be encoded as values for parameters such as pitch lag, amplitude and phase (e.g., global alignment and band alignments). For example, the encoder 204 may be configured to output the encoded excitation signal 226 in a form that includes one or more codebook indices. Calculation of this quantized representation of the residual signal (e.g., by quantizer B 224, for example) may include selecting such indices and calculating such values. Encoding of the pitch structure may include interpolation of a pitch prototype waveform, which operation may include calculating a difference between successive pitch pulses. Modeling of the long-term structure may be disabled for frames corresponding to unvoiced speech, which is typically noise-like and unstructured.

Some implementations of the decoder 208 may be configured to output the excitation signal 232 to another decoder (e.g., a highband decoder) after the long-term structure (pitch or harmonic structure) has been restored. For example, such a decoder may be configured to output the excitation signal 232 as a dequantized version of the encoded excitation signal 226. Of course, it is also possible to implement the decoder 208 such that the other decoder performs dequantization of the encoded excitation signal 226 to obtain the excitation signal 232.

In some configurations, the encoder 204 may utilize prototype pitch period encoding techniques. Prototype pitch period encoding techniques exploit the fact that voiced speech is typically periodic in nature. In particular, voiced speech tends to include recurring cycles that do not change rapidly in time (e.g., within a frame). These recurring cycles are referred to as "pitch cycles," since they recur at the fundamental frequency or pitch of the voiced speech. Prototype pitch period encoding techniques extract and encode a representative pitch cycle for each frame. This representative pitch cycle is referred to as a prototype pitch period (PPP) signal. The encoded PPP signal may be transmitted to the decoder 208 (as part of the encoded excitation signal 226, for example), which may reconstruct or synthesize speech by interpolating pitch cycles between PPP signals.

Some configurations of the systems and methods disclosed herein provide bit rate reduction of PPP signal encoding based on a new band alignment search strategy. In some PPP-based speech coding systems, such as in EVRC specifications, only the last PPP signal of each speech frame is quantized and transmitted to a decoder. A decoder may utilize waveform interpolation techniques to generate a decoded frame based on a current frame PPP signal (e.g., the last PPP signal of the current frame) and a previous frame PPP signal (e.g., the last PPP signal of the previous frame). This can reduce the average bit rate of the coding system. In EVRC full rate PPP signal quantization, the PPP signal is quantized and both amplitude and phase information are transmitted to a decoder. In EVRC, the amplitude information is vector quantized, but the phase information is quantized using scalar quantization. Scalar quantization may require a higher number of bits for the phase quantization compared to vector quantization.

Figure 3:
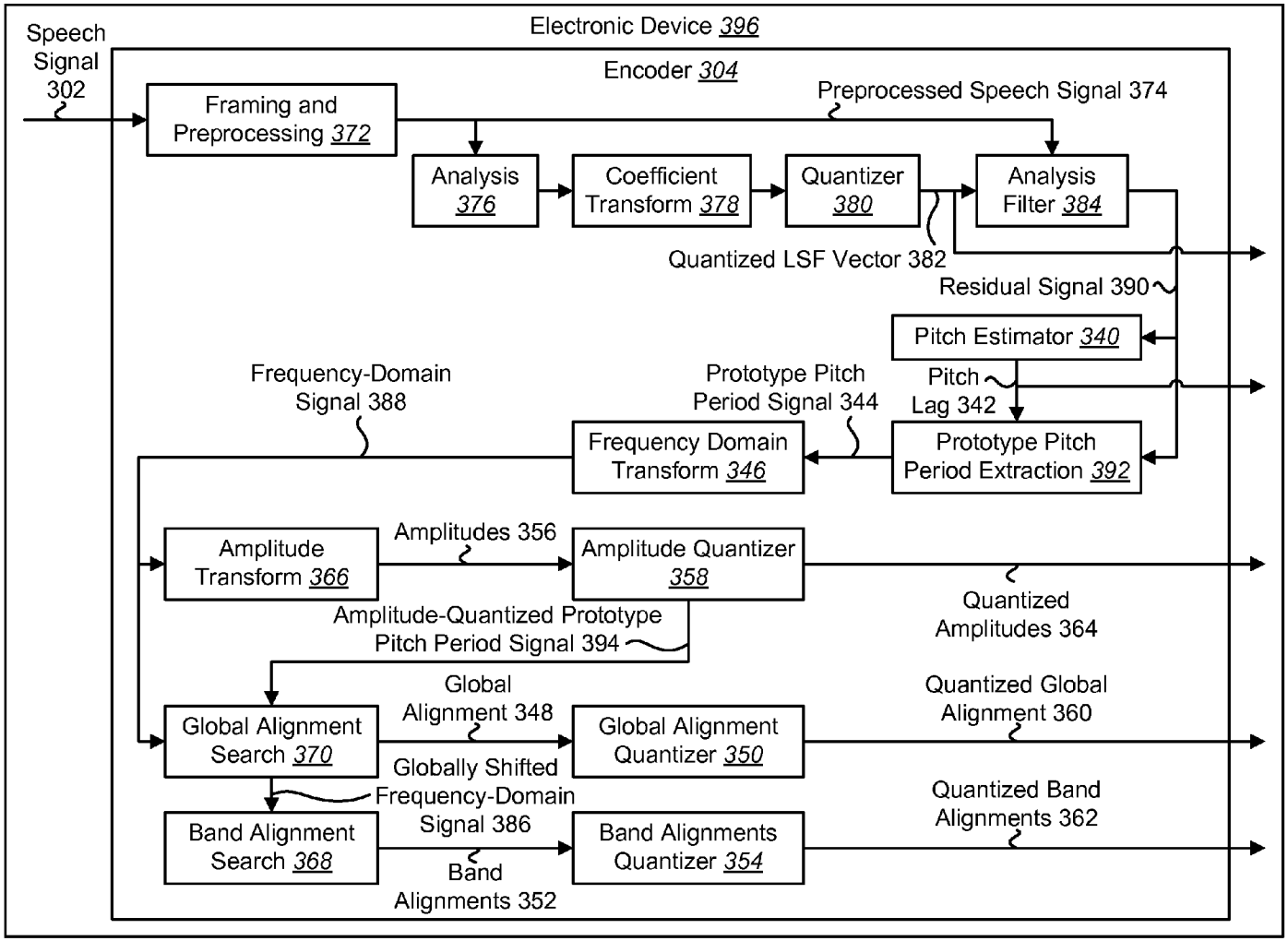
FIG. 3 is a block diagram illustrating one configuration an electronic device in which systems and methods for quantizing phase information may be implemented.

FIG. 3 is a block diagram illustrating one configuration an electronic device 396 in which systems and methods for quantizing phase information may be implemented. Examples of the electronic device 396 include smartphones, cellular phones, landline phones, headsets, desktop computers, laptop computers, televisions, gaming systems, audio recorders, camcorders, still cameras, automobile consoles, etc. One or more of the encoders described above may be implemented in accordance with the encoder 304 described in connection with FIG. 3. As used herein, the term "phase information" may be information that indicates timing or phase corresponding to a PPP signal (e.g., band alignments)

The encoder 304 illustrated in FIG. 3 utilizes PPP signal encoding techniques in accordance with the systems and methods disclosed herein. In this example, the encoder 304 includes a framing and preprocessing module 372, an analysis module 376, a coefficient transform 378, a quantizer 380, an analysis filter 384, a pitch estimator 340, a PPP extraction module 392, a frequency domain transform module 346, an amplitude transform module 366, a global alignment search module 370, a band alignment search module 368, a global alignment quantizer 350, a band alignments quantizer 354 and/or an amplitude quantizer 358. It should be noted that the encoder 304 and one or more of the components of the encoder 304 may be implemented in hardware (e.g., circuitry), software or a combination of both. For example, the band alignment search module 368 and/or the band alignments quantizer 354 may be implemented in hardware (e.g., circuitry), software or a combination of both. It should be noted that lines or arrows in the block diagrams herein may denote couplings between components or elements. For example, the band alignment search module 368 may be coupled to the band alignments quantizer 354.

The speech signal 302 (e.g., input speech s) may be an electronic signal that contains speech information. For example, an acoustic speech signal may be captured by a microphone and sampled to produce the speech signal 302. In some configurations, the speech signal 302 may be sampled at 16 kbps. Alternatively, the electronic device 396 may receive the speech signal 302 from another device (e.g., a Bluetooth headset). The speech signal 302 may comprise a range of frequencies as described above in connection with FIG. 1.

The speech signal 302 may be provided to the framing and preprocessing module 372. The framing and preprocessing module 372 may divide the speech signal 302 into a series of frames. Each frame may be a particular time period. For example, each frame may correspond to 20 ms of the speech signal 302. The framing and preprocessing module 372 may perform other operations on the speech signal, such as filtering (e.g., one or more of low-pass, high-pass and band-pass filtering). Accordingly, the framing and preprocessing module 372 may produce a preprocessed speech signal 374 (e.g., S(p), where p is a sample number) based on the speech signal 302.

The analysis module 376 may determine a set of coefficients (e.g., linear prediction analysis filter A(z)). For example, the analysis module 376 may encode the spectral envelope of the preprocessed speech signal 374 as a set of coefficients as described in connection with FIG. 2.

The coefficients may be provided to the coefficient transform 378. The coefficient transform 378 transforms the set of coefficients into a corresponding LSF vector (e.g., LSFs, LSPs, ISFs, ISPs, etc.) as described above in connection with FIG. 2.

The LSF vector is provided to the quantizer 380. The quantizer 380 quantizes the LSF vector into a quantized LSF vector 382. For example, the quantizer may perform vector quantization on the LSF vector to yield the quantized LSF vector 382. In some configurations, LSF vectors may be generated and/or quantized on a subframe basis. In these configurations, only quantized LSF vectors corresponding to certain subframes (e.g., the last or end subframe of each frame) may be sent to a decoder. The quantized LSF vector 382 may be one example of a filter parameter 228 described above in connection with FIG. 2.

The quantized LSF vector 382 is used to define the analysis filter 384. The analysis filter 384 produces a residual signal 390. For example, the analysis filter 384 filters the preprocessed speech signal 374 based on the quantized LSF vector 382 (e.g., A(z)).

In some configurations, the PPP quantization may be accomplished in an open loop manner. For example, there may be no error minimization as in an ACELP excitation search. The analysis module 376 may compute the LSF vector. The quantized LSF vector 382 may be used to generate the analysis filter 384. Passing the preprocessed speech signal 374 through the analysis filter may generate the residual signal 390. The residual signal 390 may be utilized to extract a prototype pitch period excitation signal.

The residual signal 390 is provided to the pitch estimator 340 and to the PPP extraction module 392. The pitch estimator 340 determines a pitch lag 342 based on the residual signal 390. For example, the pitch estimator 340 may estimate a distance (in samples, for instance) between a pair of pitch peaks in the residual signal 390, which approximates the pitch lag 342. In some configurations, the pitch estimator 340 may alternatively determine the pitch lag 342 based on the speech signal 302 or preprocessed speech signal 374. The pitch lag 342 may be provided to the PPP extraction module 392.

The PPP extraction module 392 determines a PPP signal 344 based on the speech signal 302. For example, the PPP extraction module 392 determines the PPP signal 344 based on the pitch lag 342 and the residual signal 390. In general, a PPP signal is one pitch cycle of a signal. For example, the PPP signal 344 may be the last pitch cycle in a frame of the residual signal 390. In some configurations, the PPP extraction module 392 may alternatively determine a PPP signal 344 of the speech signal 302 or of the preprocessed speech signal 374. The PPP signal 344 may be provided to the frequency domain transform module 346.

The frequency domain transform module 346 may transform the PPP signal 344 into a first frequency-domain signal 388 (e.g., a target PPP signal). Transforming the PPP signal 344 may include determining a discrete-time Fourier series (DTFS or DFS) of the PPP signal 344 or performing a discrete Fourier transform (DFT) on the PPP signal 344. For example, the frequency domain transform module 346 may operate in accordance with Equation (1).

$$X_T(i) = \frac{1}{L}\sum_{m=0}^{L-1} x(m)e^{-j\frac{2\pi}{L}im} \tag{1}$$

In Equation (1), x(m) is the PPP signal 344 of length L, m is a sample index of the PPP signal 344, i is a frequency index (where $0 \le i < L$), j is the imaginary unit and $X_T(i)$ is the first frequency-domain signal 388 (e.g., the DTFS of x(m)). It should be noted that $X_T$ is a complex vector and may be represented as a sum of a real vector $X_T.a$ and an imaginary vector $X_T.b$ such that $X_T = X_T.a + jX_T.b$ . The first frequency-domain signal 388 (e.g., $X_T$) may be referred to as a "target PPP signal." Each DTFS component $X_T(i)$ at frequency index i has an amplitude and phase. In a DTFS, each component corresponds to a single frequency or a frequency index. It should be noted that the number of frequency indices of the first frequency-domain signal is the same as the duration or length (e.g., L) of the PPP signal 344, which is the pitch lag 342 for the frame. Note that due to the symmetry of a Fourier series or a Fourier transform of a real signal, approximately half of the components of $X_T(i)$ is sufficient to reconstruct the remaining half of the coefficients. It should also be noted that a DFT is similar to a discrete-time Fourier transform (DTFT), except that the original signal for a DFT (e.g., x(m)) is presumed to be periodic, whereas the original signal for a DTFT may be aperiodic.

The first frequency-domain signal 388 may be provided to the amplitude transform module 366 and to the global alignment search module 370. The amplitude transform module 366 may map the first frequency-domain signal 388 (e.g., $X_T$) into a plurality of subbands. For example, the amplitude transform module 366 may group frequency indices (i) of the first frequency-domain signal into multiple subbands (e.g., frequency bins). A "frequency bin" may be a frequency range or band (e.g., subband). In some configurations, the plurality of subbands may include one or more subbands with non-uniform bandwidths (in accordance with a perceptual scale, for instance). For example, higher subbands may have wider bandwidths relative to lower subbands. For instance, higher subbands may include more frequency indices of $X_T$ than lower subbands. Mapping the first frequency-domain signal 388 may be based on the length (e.g., L) of the first frequency-domain signal (e.g., the mapping may differ based on L).

The amplitude transform module 366 may determine an amplitude for each subband based on the frequency index/indices included in each subband (e.g., frequency bin). For example, the amplitude for each subband may be an average amplitude corresponding to the frequency index/indices included in each subband. For example, the amplitude for subbands with two or more frequency indices may be the average amplitude of the first and last frequency indices. The amplitude of each subband with only one frequency index may be the amplitude of that frequency index i. Alternatively, the amplitude of each subband (e.g., frequency bin) can be the interpolated amplitude corresponding to the mid frequency of that bin. The interpolation may be done based on two amplitudes of the DTFS components around the subband midpoint. The phase for each subband may be discarded. For example, the phase for each subband is set to 0.

As described above, the amplitude transform module 366 may determine amplitudes 356. The amplitude transform module 366 may provide the amplitudes 356 (e.g., an amplitude vector) to the amplitude quantizer 358. For example, the amplitude transform module 366 may provide the amplitudes 356 (e.g., amplitude spectra in the frequency domain) of the first frequency-domain signal 388 (e.g., $X_T$), a globally shifted frequency-domain signal (e.g., $X_{GS}$) or a band shifted frequency-domain signal (e.g., $X_{BS}$). For instance, the amplitude transform module 366 may determine averaged amplitudes corresponding to each of the subbands as described above and provide the amplitudes 356 to the amplitude quantizer 358.

The amplitude quantizer 358 may quantize the amplitudes 356 utilizing vector quantization to obtain quantized amplitudes 364. For example, the amplitude quantizer 358 may determine an index corresponding to a vector in a codebook or lookup table that best matches the amplitudes 356. The quantized amplitudes 364 may be the index to the codebook or lookup table. The quantized amplitudes 364 may be sent to a decoder. For example, the encoder 304 may provide the quantized amplitudes 364 to a transmitter as part of a bitstream, which may transmit the bitstream to an electronic device that includes a decoder.

The amplitude quantizer 358 may also generate an amplitude quantized PPP signal 394. For example, the amplitude quantizer 358 may generate the amplitude-quantized PPP signal 394 based on the amplitudes 356 that correspond to the first frequency-domain signal 388. The amplitude-quantized PPP signal 394 may be a frequency-domain signal with quantized amplitudes. The amplitude-quantized PPP signal 394 may be provided to the global alignment search module 370.

The global alignment search module 370 may determine a global alignment 348 between two frequency-domain PPP signals. In particular, the global alignment search module 370 may align two PPP signals in the time domain by a frequency domain shift. Alternatively, the global alignment search module 370 may align two PPP signals in the time domain by taking a time domain correlation. Phase alignment may be performed in two steps. The global alignment 348 may be determined first as follows.

The global alignment search module 370 may generate a second frequency-domain signal (e.g., another DTFS, $X_C$) based on the amplitude quantized PPP signal 394. The number of frequency indices of the second frequency-domain signal may be the same as the number of frequency indices of the first frequency-domain signal (e.g., L). The phase for all of the frequency indices of the second frequency-domain signal may be 0. The amplitude for each of the frequency indices in the same subband of the second frequency-domain signal may be the same, and may be the amplitude (e.g., average amplitude) for each subband described above. In some implementations, the subband structure of the amplitude quantization can be different from that of a band alignment search. For example, a time domain version of $X_C$ may be approximately similar to a shifted version of a time domain version of $X_T$ (although not exactly, since there are some frequency band-based shifts where a second signal is not exactly equal to a shifted version of a first signal, for example). This is because phase information has been discarded in $X_C$ and the amplitudes for each of the subbands are the averaged amplitudes from $X_T$. The second frequency-domain signal (e.g., $X_C$) may be referred to as a "current PPP signal."

The global alignment search module 370 may determine a global alignment 348 (e.g., $S_G$) based on the first frequency-domain signal 388 (e.g., $X_T$). For example, the global alignment search module 370 may determine a shift corresponding to the maximum correlation of the first frequency-domain signal 388 (e.g., $X_T$) and the second frequency-domain signal (e.g., $X_C$). This shift is the global alignment 348. The global alignment 348 may be provided to the global alignment quantizer 350. It should be noted that calculating the correlation in the frequency domain may reduce computational complexity (versus in the time domain), although this is analogous to calculating the correlation of two time-domain waveforms. Additionally, the correlation may be calculated in the frequency domain since a relative phase difference for each subband is missing.

The global alignment quantizer 350 may quantize the global alignment 348 to produce a quantized global alignment 360 (e.g., $S_{GQ}$ samples). For example, the global alignment quantizer 350 may quantize the global alignment 348 utilizing scalar quantization to obtain the quantized global alignment 360. For instance, the global quantizer 350 may select a best quantized value (e.g., a closest quantized value or a quantized value that minimizes an error metric) utilizing uniform or non-uniform scalar quantization to obtain the quantized global alignment 360. The quantized global alignment 360 may be provided (not shown in FIG. 3) to the global alignment search module 370. The quantized global alignment 360 may be sent to a decoder. For example, the encoder 304 may provide the quantized global alignment 360 to a transmitter as part of a bitstream, which may transmit the bitstream to an electronic device that includes a decoder.

The global alignment search module 370 may determine a globally shifted frequency-domain signal 386 (e.g., $X_{GS}$). The globally shifted frequency-domain signal 386 may be based on the second frequency-domain signal. For example, the global alignment search module 370 may multiply the second frequency-domain signal by a factor in accordance with Equation (2).

$$X_{GS}(i)=X_C(i)e^{-j2\pi S_{GQ}/L} \tag{2}$$

In Equation (2), $X_{GS}$ is the globally shifted frequency-domain signal 386, $X_C$ is the second frequency-domain signal, $S_{GQ}$ is the quantized global alignment 360 and $0 \le i < L$. The globally shifted frequency-domain signal 386 may be provided to the band alignment search module 368. It should be noted that multiplying a linear phase in the frequency domain is equivalent to a circular shift in the time domain. Shifting the second frequency-domain signal according to the quantized global alignment 360 may not accurately approximate the phase of all the harmonics of the first frequency-domain signal. Accordingly, the band alignment search module 368 may determine band alignments 352 as follows.

The band alignment search module 368 may determine a plurality of band alignments 352 corresponding to the plurality of subbands. Each band alignment 352 may be a phase shift for the first frequency index in each subband of the globally shifted frequency domain-signal 386 (e.g., $X_{GS}$). For instance, a search for a band alignment index is performed for frequency subbands that are defined by a perceptual scale. A known approach (e.g., EVRC specifications) allows multiple rotations around a unit circle in searching for a band alignment. In some cases, this results in a lower-resolution search with multiple rotations around the unit circle. In contrast, the systems and methods disclosed herein only allow a single rotation around the unit circle in searching for a band alignment. In some cases, this results in a higher-resolution search with only a single rotation around the unit circle.

For clarity, one example of the known approach for band alignment searching in accordance with EVRC specifications is given hereafter. In EVRC, the band alignment search is done using the following Equation (3).

$$\text{band_alignment}(j) = \frac{16}{\eta} + \underset{n}{\operatorname{argmax}}\left(\sum_k \left(\begin{pmatrix} X_{GS}\cdot a(k)X_T\cdot a(k) + \\ X_{GS}\cdot b(k)X_T\cdot b(k) \end{pmatrix}\cos(\Theta) + \begin{pmatrix} X_{GS}\cdot b(k)X_T\cdot a(k) - \\ X_{GS}\cdot a(k)X_T\cdot b(k) \end{pmatrix}\sin(\Theta)\right)\right) \tag{3}$$

In Equation (3), band_alignment(j) is a band alignment for the j-th subband. In this example, 17 subbands are assumed, where $0 \le j < 17$. However, the number of subbands may be different depending on the implementation. In Equation (3), $$\eta = \begin{cases} 1; & j < 3 \\ 0.5; & 3 \le j < 17. \end{cases}$$

Furthermore, n is a band alignment index, where $$-\frac{16}{\eta} \le n < \frac{16}{\eta},$$

with n increasing in steps of 1. The summation in Equation (3) is performed for all $$k \in \left[0, \left\lfloor \frac{L}{2} \right\rfloor\right]$$

such that $$lband(j) \le k\frac{Fs}{L} < hband(j),$$

where k is a harmonic number, Fs is a sampling frequency (e.g., 8000 samples per second), L is the pitch lag, lband(j) is a lower frequency boundary of the j-th subband and hband(j) is an upper frequency boundary of the j-th subband to be searched for the band alignment. In one example, lband(j)=F_BAND[j] and hband(j)=F_BAND[j+1]. For instance, F_BAND[18]={0, 200, 300, 400, 500, 600, 850, 1000, 1200, 1400, 1600, 1850, 2100, 2375, 2650, 2950, 3250, 4000}. If for a given lband, hband and L, there is no k such that $$lband \le k\frac{Fs}{L} < hband,$$

then band_alignment(j)=INVALID_ID .

$X_{GS}$.a(k) and $X_{GS}$.b(k) are DTFS coefficients of the globally shifted frequency-domain signal 386 (e.g., $X_{GS}$). For example, $X_{GS}$.a(k) are the real DTFS coefficients and $X_{GS}$.b(k) are the imaginary coefficients of $X_{GS}$ (e.g., $X_{GS}=X_{GS}.a(k)+jX_{GS}.b(k)$). $X_T$.a(k) and $X_T$.b(k) are DTFS coefficients of the first frequency-domain signal (e.g., $X_T$ or target PPP signal). For example, $X_T$.a(k) are the real DTFS coefficients and $X_T$.b(k) are the imaginary coefficients of $X_T$ (e.g., $X_T=X_T.a(k)+jX_T.b(k)$). In Equation (3), Θ is a band alignment angle, where $$\Theta = \left(\frac{2\pi}{L}\right)n\eta k$$

and Θ=2π corresponds to a full circular rotation.

In this example, a band alignment is determined for each subband and can be represented by the band alignment angle Θ or by the band alignment index n. In EVRC, the band alignment index n and band alignment angle Θ are related by $$\Theta = \left(\frac{2\pi}{L}\right)n\eta k.$$

Equation (3) shifts each subband j of the globally shifted frequency-domain signal (e.g., $X_{GS}$) according to each band alignment index n. The shifting is done by selecting the band alignment angle $$\Theta = \left(\frac{2\pi}{L}\right)n\eta k.$$

Equation (3) determines the band alignment index n that results in the maximum correlation between the band-shifted version of $X_{GS}$ and $X_T$ for each subband j.

Θ may be rewritten as $$\Theta = \frac{2\pi lk}{L},$$

where $l\in\{-16, -15, \ldots, 0, \ldots, 14, 15\}$ for j<3 and $l\in\{-16.0, -15.5, -15.0, \ldots, 0, \ldots, 14.0, 14.5, 15.0, 15.5\}$ for j≥3. Accordingly, l is the search range from −16 to 16 in steps of 1.0 or 0.5. It can be observed that the term $$\frac{2\pi lk}{L}$$

wraps around [0, 2π] in this example. Specifically, the band alignment angle Θ increases from the angle 0 and passes the angle 2π around the origin multiple times.

For instance, consider the case where L=40, k=10, Fs=8000 and j=11. In this case, $$\Theta = \frac{2\pi}{40}\cdot l\cdot 10 = \frac{\pi}{2}\cdot l.$$

This yields Θ to take only multiples of $$\frac{\pi}{4},$$

which results in Θ wrapping around the unit circle and only searching at the angles $$0, \frac{\pi}{4}, \frac{\pi}{2}, \frac{3\pi}{4}, \pi, \frac{5\pi}{4}, \frac{3\pi}{2}, \frac{7\pi}{4}, 2\pi$$

for j=11. Similar angles may be searched for all j≥3. As a result, the search angles are not monotonically increasing in [0, 2π]. For some pitch lags, this results in searching at the same band alignment angle multiple times (for multiple band alignment index values), which results in reduced search resolution.

In contrast to the known approach, some configurations of the systems and methods disclosed herein only allow a single rotation around the unit circle in searching for a band alignment. The approach disclosed by the systems and methods herein is described hereafter.

The band alignment search module 368 may determine a plurality of band alignments 352 corresponding to the plurality of subbands. For example, determining the plurality of band alignments 352 corresponding to the plurality of subbands may include determining a band alignment 352 based on a correlation (e.g., a maximum correlation) between a portion of the first frequency-domain signal 388 (e.g., $X_T$) and a portion of the globally shifted frequency-domain signal 386 (e.g., $X_{GS}$) for at least one of the plurality of subbands. It should be noted that there are cases where there are no frequency indices of the DTFS that fall within a given subband (e.g., frequency bin). For example, a band alignment may not be determined for subbands (e.g., frequency bins) without a k. The portion of the first frequency-domain signal may be a frequency bin and/or a subband. Additionally, the portion of the globally shifted frequency-domain signal 386 may be a corresponding frequency bin and/or a corresponding subband.

Determining the plurality of band alignments 352 may include sequentially shifting at least one of the portion of the first frequency-domain signal and the portion of the globally shifting frequency-domain signal. For example, sequentially shifting may include shifting the portion of the globally shifted frequency domain signal 386 (or the portion of the first frequency domain signal) in a sequence of band alignment indices (e.g., n) or band alignment angles (e.g., $\hat{\Theta}$). The band alignment search module 368 may perform the sequential shifting within a single rotation around the unit circle. The sequential shifting may increase monotonically. In some configurations, a shift resolution may vary based on subband. For example, the shift resolution may be higher for a higher subband compared to the shift resolution of a lower subband. For instance, the sequence of band alignment indices (e.g., n) or band alignment angles (e.g., $\hat{\Theta}$) may be more closely spaced and/or may include more band alignment indices or band alignment angles for a higher subband.

The single rotation may be within a range [0, 2π], [−ππ] or any other range that includes only a single rotation around the unit circle. It should be noted that one or more of the range endpoints may or may not be included in the single rotation. For example, the single rotation may be within a range [0, 2π) or [−π, π).

In some configurations, the band alignment search module 368 may determine the plurality of band alignments 352 in accordance with Equation (4).

$$\text{band_alignment}(j) = \underset{n}{\operatorname{argmax}}\left(\sum_k \left(\begin{pmatrix} X_{GS}\cdot a(k)X_T\cdot a(k) + \\ X_{GS}\cdot b(k)X_T\cdot b(k)\end{pmatrix}\cos(\hat{\Theta}) + \begin{pmatrix} X_{GS}\cdot b(k)X_T\cdot a(k) - \\ X_{GS}\cdot a(k)X_T\cdot b(k)\end{pmatrix}\sin(\hat{\Theta})\right)\right) \quad (4)$$

The terms in Equation (4) may be similar to corresponding terms given in Equation (3) as defined above. In Equation (4), however, a band alignment angle $\hat{\Theta}$ is defined as provided by Equation (5).

$$\hat{\Theta} = \frac{2\pi}{N}\cdot n\cdot\frac{k+1}{k_{ib}+1} \quad (5)$$

In Equation (5), n is a band alignment index as described above, k is a harmonic number as described above, N is a total number of band alignment indices (e.g., $n\epsilon[0, N-1]$) and $k_{ib}$ is minimum harmonic number in each subband. In particular, $k_{ib}$ is the minimum value (e.g., index) of k that makes the k-th DTFS component correspond to a frequency inside each subband (between the frequencies lband(j) and hband(j)). For example, $$k_{ib} = \underset{k}{\operatorname{argmin}} lband(j) \le k\cdot\frac{Fs}{L} \le hband(j),$$

where L is the number of samples in the PPP signal (e.g., the pitch lag) and k is the frequency index in the DTFS. A band alignment 352 may be expressed as a band alignment angle $\hat{\Theta}$ or a band alignment index n, which are related as illustrated by Equation (5). It should be noted that Equation (4) and Equation (5) may be applicable for any sampling frequency Fs. In some configurations, the sampling frequency Fs may be set to 8000 samples per second for narrowband speech (in accordance with the original EVRC specification, for example). In other configurations, the sampling frequency Fs may be 16000 samples per second for wideband speech (although different conventions may be utilized, for instance).

The band alignment search module 368 may search for the plurality of band alignments 352 in accordance with Equation (4). This may be accomplished as described in connection with Equation (3) above, for example, except that the band alignment angle $\hat{\Theta}$ is given in accordance with Equation (5). Once the band alignment index n that maximizes the correlation between the globally shifted frequency domain-signal 386 (e.g., $X_{GS}$) and the first frequency-domain signal 388 (e.g., $X_T$) is determined for a subband, the scaling factor $$\frac{k+1}{k_{ib}+1}$$

ensures that the band alignment angle $\hat{\Theta}$ changes linearly for the rest of the frequency indices (e.g., DTFS components) included in the given subband. Accordingly, band alignment searching in accordance with the systems and methods disclosed herein may ensure a linearly increasing phase in one or more subbands. In some configurations, the band alignment search module 368 may shift each band of the globally shifted frequency-domain signal 386 (e.g., $X_{GS}$) based on the band alignments 352 to obtain a band shifted frequency-domain signal (e.g., $X_{BS}$).

It should be noted that determining band alignments 352 in accordance with the band alignment search (and in accordance with Equation (5), for example) may be one kind of quantization that is applied to the PPP signal 344. Additionally or alternatively, determining a global alignment 348 may also be considered quantization of the PPP signal 344.

The approach to band searching disclosed herein eliminates the issue with the known approach to band alignment searching that can repeatedly wrap around 2π. This also yields a Gaussian-like band alignment index distribution, which enables vector quantization of the plurality of band alignments 352. For example, each resulting band alignment (e.g., band alignment index n or band alignment angle $\hat{\Theta}$) has a probability distribution such that it enables effective vector quantization. Examples of vector quantization include any type of vector quantization such as multi-stage vector quantization, split vector quantization, a combination of both multi-stage and split vector quantization or any other type of vector quantization. Vector quantization reduces the number of bits required to represent the phase information of the PPP signal. This is in contrast to the known EVRC approach, which uses scalar quantization. For scalar quantization, separate indices need to be sent for all the band alignments. However, vector quantization utilizes inter-indices correlation so the effective number of bits needed to quantize the alignment indices can be reduced. For example, the approach disclosed herein reduces the number of bits used to transmit band alignments by about 40% versus the EVRC approach. For instance, EVRC utilizes 99 bits for band alignments in narrowband speech, while the approach disclosed herein may only utilize 61 bits for wideband speech without degrading speech quality. Thus, the systems and methods disclosed herein may be utilized to quantize a PPP signal using fewer bits compared to known phase quantization techniques and may accordingly reduce the bit rate of a PPP coding system.

The band alignments 352 (e.g., a band alignment vector) may be provided to the band alignments quantizer 354. The band alignments quantizer 354 may quantize the plurality of band alignments 352 utilizing vector quantization to obtain a quantized plurality of band alignments 362. Examples of the band alignments quantizer 354 include any type of vector quantizer (e.g., a multi-stage vector quantizer, split vector quantizer, a combination multi-stage and split vector quantizer or any other type of vector quantizer). The band alignments quantizer 354 may determine an index corresponding to a vector in a codebook or lookup table that best matches the band alignments 352. The quantized band alignments 362 may be the index to the codebook or lookup table. The quantized band alignments 362 may be sent to a decoder. For example, the encoder 304 may provide the quantized band alignments 362 to a transmitter as part of a bitstream, which may transmit the bitstream to an electronic device that includes a decoder.

It should be noted that the quantized amplitudes 364, the quantized band alignments 362, the quantized global alignment 360 and the pitch lag 342 may be examples of parameters included in an encoded excitation signal, which may be transmitted to another electronic device that includes a decoder. For instance, the quantized amplitudes 364, the quantized band alignments 362, the quantized global alignment 360 and the pitch lag 342 may be examples of parameters included in the encoded excitation signal 226 described in connection with FIG. 2. Additionally or alternatively, the quantized LSF vector 382, the quantized amplitudes 364, the quantized band alignments 362, the quantized global alignment 360 and the pitch lag 342 may be included in the encoded speech signal 106 described above in connection with FIG. 1. For example, the electronic device 396 may transmit and/or store one or more of the quantized LSF vector 382, the quantized amplitudes 364, the quantized band alignments 362, the quantized global alignment 360 and the pitch lag 342. In some configurations, the transmission may be sent via a wireless and/or wired network (e.g., cellular network, local area network, the Internet, etc.). For example, the electronic device 396 may include a transmitter (e.g., transmitter circuitry) that transmits one or more of the quantized LSF vector 382, the quantized amplitudes 364, the quantized band alignments 362, the quantized global alignment 360 and the pitch lag 342.

Figure 4:
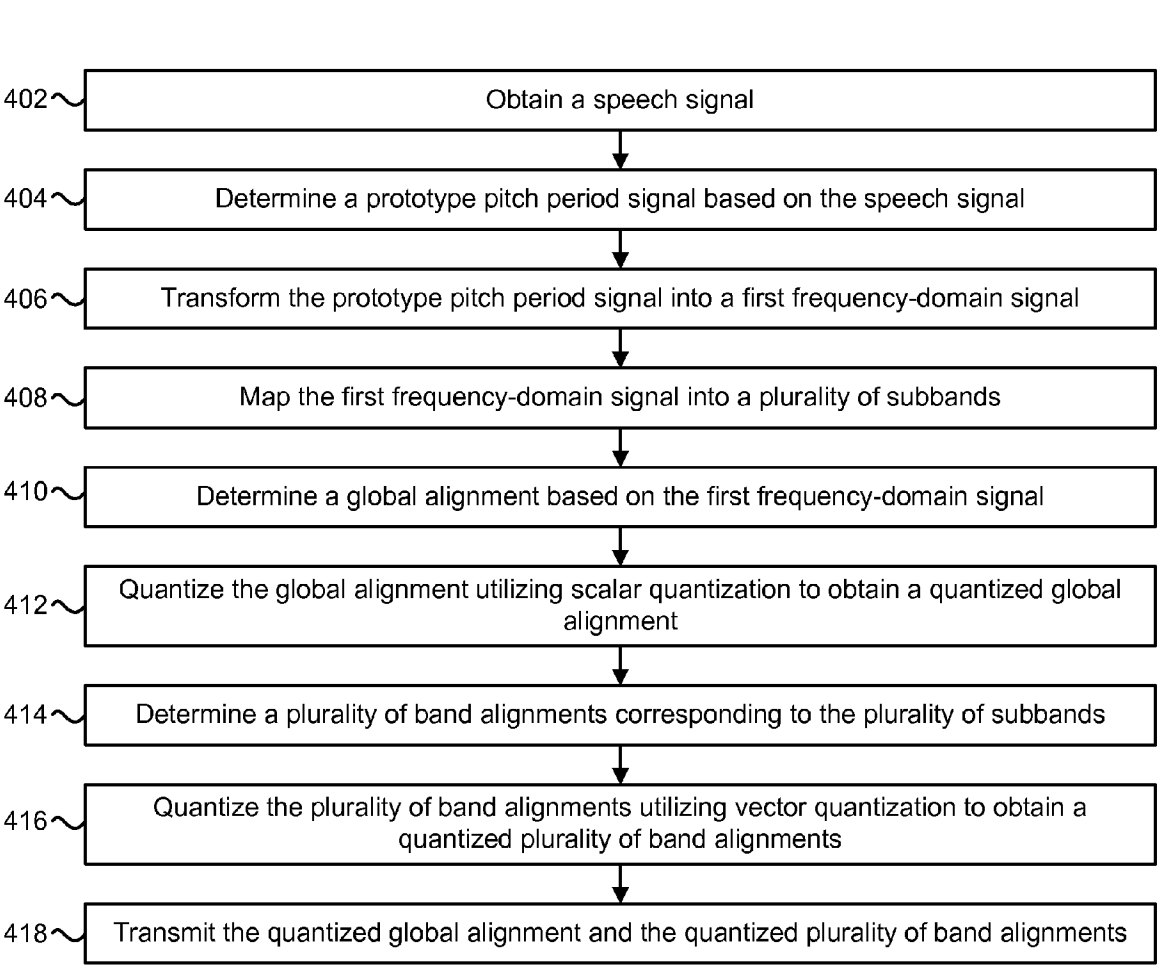
FIG. 4 is a flow diagram illustrating one configuration of a method for quantizing phase information.

FIG. 4 is a flow diagram illustrating one configuration of a method 400 for quantizing phase information. The method 400 may be performed by an electronic device 396. The electronic device 396 may obtain 402 a speech signal. For example, the electronic device 396 may capture and sample an acoustic speech signal to produce the speech signal 302 as described in connection with FIG. 3.

The electronic device 396 may determine 404 a PPP signal 344 based on the speech signal 302. For example, the electronic device 396 may determine the last PPP signal of a current frame as described in connection with FIG. 3.

The electronic device 396 may transform 406 the PPP signal 344 into a first frequency-domain signal 388 (e.g., $X_T$). For example, the electronic device 396 may determine a DTFS of the PPP signal 344 as described in connection with FIG. 3 (and in accordance with Equation (1), for instance).

The electronic device 396 may map 408 the first frequency-domain signal (e.g., $X_T$) into a plurality of subbands. For example, the electronic device 396 may distribute frequency indices of the first frequency-domain signal into multiple subbands as described in connection with FIG. 3.

The electronic device 396 may determine 410 a global alignment 348 (e.g., $S_G$) based on the first frequency-domain signal 388 (e.g., $X_T$). The electronic device 396 may also generate a second frequency-domain signal (e.g., $X_C$) based on an amplitude quantized PPP signal 394 as described above. The electronic device 396 may then determine 410 a global alignment 348 (e.g., $S_G$) corresponding to the maximum correlation of the first frequency-domain signal 388 (e.g., $X_T$) and the second frequency-domain signal (e.g., $X_C$). This may be accomplished as described above in connection with FIG. 3.

The electronic device 396 may quantize 412 the global alignment 348 utilizing scalar quantization to obtain a quantized global alignment 360. For example, the electronic device 396 may quantize 412 the global alignment utilizing uniform or non-uniform scalar quantization as described above in connection with FIG. 3.

The electronic device 396 may determine 414 a plurality of band alignments 352 corresponding to the plurality of subbands. For example, the electronic device 396 may determine a globally shifted frequency-domain signal (e.g., $X_{GS}$) as described above. The electronic device 396 may then determine 414 the plurality of band alignments 352 by determining a band alignment 352 corresponding to a correlation between the a portion of the first frequency-domain signal 388 (e.g., $X_T$) and a portion of the globally shifted frequency-domain signal 386 (e.g., $X_{GS}$) within a single rotation around the unit circle for at least one of the plurality of subbands. This may be accomplished as described in connection with FIG. 3 (and in accordance with Equation (4) and Equation (5), for instance).

The electronic device 396 may quantize 416 the plurality of band alignments 352 utilizing vector quantization to obtain a quantized plurality of band alignments 362. For example, the electronic device 396 may determine an index corresponding to a vector in a codebook or lookup table that best matches the band alignments 352 as described in connection with FIG. 3.

The electronic device 396 may transmit 418 the quantized global alignment 360 and the quantized plurality of band alignments 362. For example, the electronic device 396 may insert the quantized global alignment 360 and the quantized plurality of band alignments 362 into a bitstream. The electronic device 396 may then transmit 418 the bitstream using a transmitter (e.g., a radio frequency (RF) transmitter).

The systems and methods disclosed herein results in a better search resolution compared to the known EVRC approach in most cases. In very rare instances, the search resolution provided by the systems and methods herein can be equal to that of EVRC, but will never be worse than that of EVRC. Better search resolution may result in increased speech quality. In comparison with the known approach, the systems and methods described herein provide novel band alignment search criteria. Additionally, the systems and methods disclosed herein generally enable increased band alignment search resolution, where the band alignments are better suited for vector quantization. Increased resolution results in improved speech quality and use of vector quantization results in fewer bits required for quantization.

Figure 5:
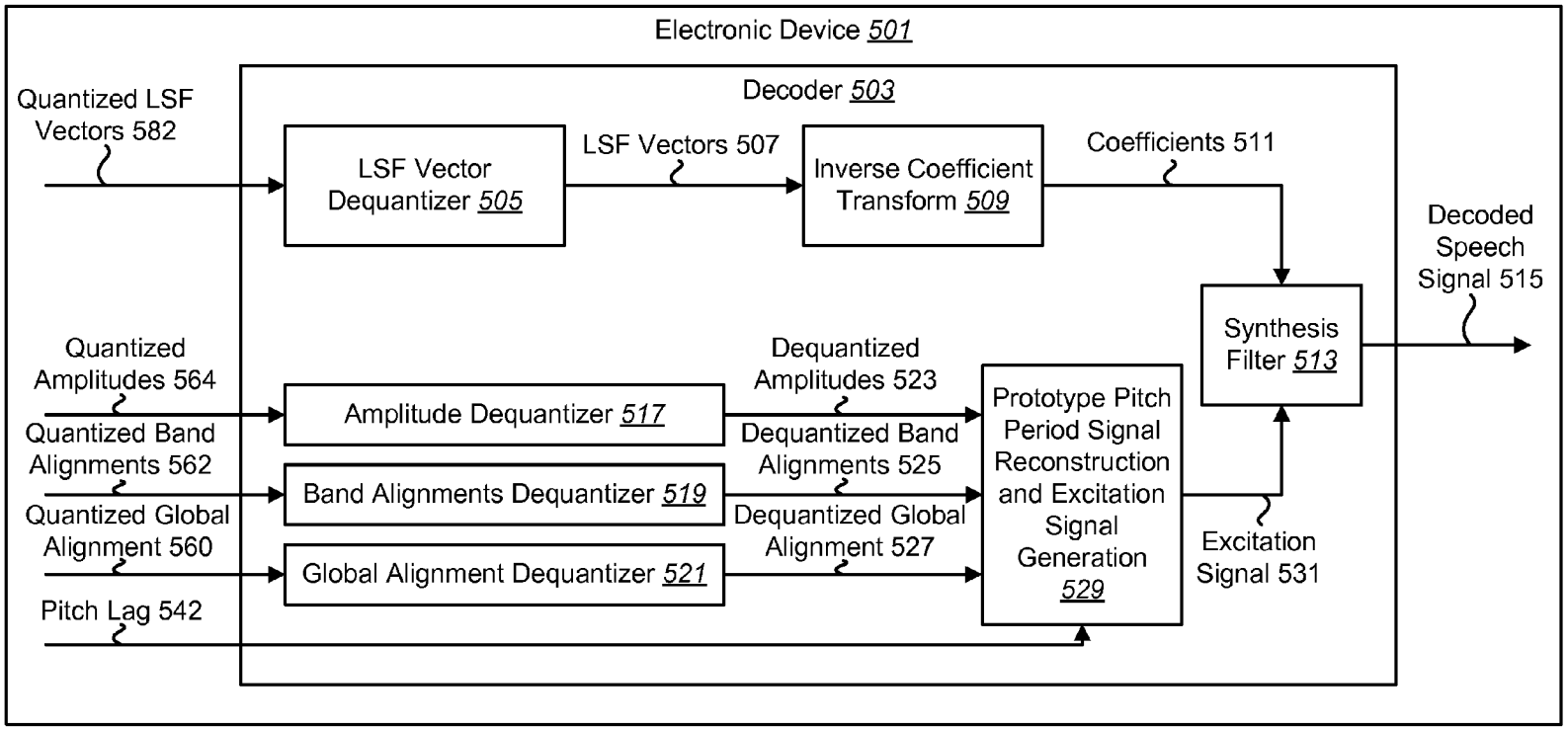
FIG. 5 is a block diagram illustrating one configuration of an electronic device configured for dequantizing phase information.

FIG. 5 is a block diagram illustrating one configuration of an electronic device 501 configured for dequantizing phase information. Examples of the electronic device 501 include smartphones, cellular phones, landline phones, headsets, desktop computers, laptop computers, televisions, gaming systems, audio recorders, camcorders, still cameras, automobile consoles, etc. The electronic device 501 includes a decoder 503. One or more of the decoders described above may be implemented in accordance with the decoder 503 described in connection with FIG. 5.

It should be noted that one or more of the components included in the electronic device 501 and/or decoder 503 may be implemented in hardware (e.g., circuitry), software or a combination of both. For example, the band alignments dequantizer 519 may be implemented in hardware (e.g., circuitry), software or a combination of both. It should also be noted that arrows within blocks in FIG. 5 or other block diagrams herein may denote a direct or indirect coupling between components.

The decoder 503 produces a decoded speech signal 515 (e.g., a synthesized speech signal) based on received parameters. Examples of the received parameters include quantized LSF vectors 582, quantized amplitudes 564, quantized band alignments 562, quantized global alignments 560 and a pitch lag 542. The quantized amplitudes 564, the quantized band alignments 562, the quantized global alignment 560 and the pitch lag 542 may be examples of parameters included in an encoded excitation signal, which may be received from another electronic device. The decoder 503 includes one or more of an LSF vector dequantizer 505, an inverse coefficient transform 509, a synthesis filter 513, an amplitude dequantizer 517, a band alignments dequantizer 519, a global alignment dequantizer 521 and a PPP signal reconstruction and excitation signal generation module 529.

The decoder 503 receives quantized LSF vectors 582 (e.g., quantized LSFs, LSPs, ISFs, ISPs, PARCOR coefficients, reflection coefficients or log-area-ratio values). In some configurations, the quantized LSF vectors 582 may be indices corresponding to a look up table or codebook.

The LSF vector dequantizer 505 dequantizes the received quantized LSF vectors 582 to produce LSF vectors 507. For example, the LSF vector dequantizer 505 may look up the LSF vectors 507 based on indices (e.g., the quantized LSF vectors 582) corresponding to a look up table or codebook.

The LSF vectors 507 may be provided to the inverse coefficient transform 509. The inverse coefficient transform 509 transforms the LSF vectors 507 into coefficients 511 (e.g., filter coefficients for a synthesis filter 1/A(z)). The coefficients 511 are provided to the synthesis filter 513.

The amplitude dequantizer 517 may dequantize the quantized amplitudes 564 to obtain dequantized amplitudes 523. For example, the amplitude dequantizer 517 may look up dequantized amplitudes 523 in a codebook or lookup table corresponding to the quantized amplitudes 564 (e.g., an index).

The band alignments dequantizer 519 may dequantize the quantized band alignments 562 to obtain dequantized band alignments 525. For example, the band alignments dequantizer 519 may look up dequantized band alignments 525 in a codebook or lookup table corresponding to the quantized band alignments 562 (e.g., an index). The quantized band alignments 562 may be vector-quantized band alignments 562. Accordingly, the band alignments dequantizer 519 may apply vector dequantization to obtain the dequantized band alignments 525.

The global alignment dequantizer 521 may dequantize the quantized global alignment 560. For example, the global alignment dequantizer 521 may convert the quantized global alignment 560 to a dequantized global alignment 527. The dequantized amplitudes 523, dequantized band alignments 525 and/or dequantized global alignment 527 may be provided to the PPP signal reconstruction and excitation signal generation module 529.

The PPP signal reconstruction and excitation signal generation module 529 may generate an excitation signal 531 based on the dequantized amplitudes 523, dequantized band alignments 525, dequantized global alignment 527 and/or the pitch lag 542. For example, the PPP signal reconstruction and excitation signal generation module 529 may reconstruct a current PPP signal that is specified by the dequantized amplitudes 523, dequantized band alignments 525 and dequantized global alignment 527. The PPP signal reconstruction and excitation signal generation module 529 may then interpolate PPP signals between a previous frame PPP signal and the current frame PPP signal to generate the excitation signal 531 for the current frame.

The excitation signal 531 may be provided to the synthesis filter 513. The synthesis filter 513 filters the excitation signal 531 in accordance with the coefficients 511 to produce a decoded speech signal 515. For example, the poles of the synthesis filter 513 may be configured in accordance with the coefficients 511. The excitation signal 531 is then passed through the synthesis filter 513 to produce the decoded speech signal 515 (e.g., a synthesized speech signal).

Figure 6:
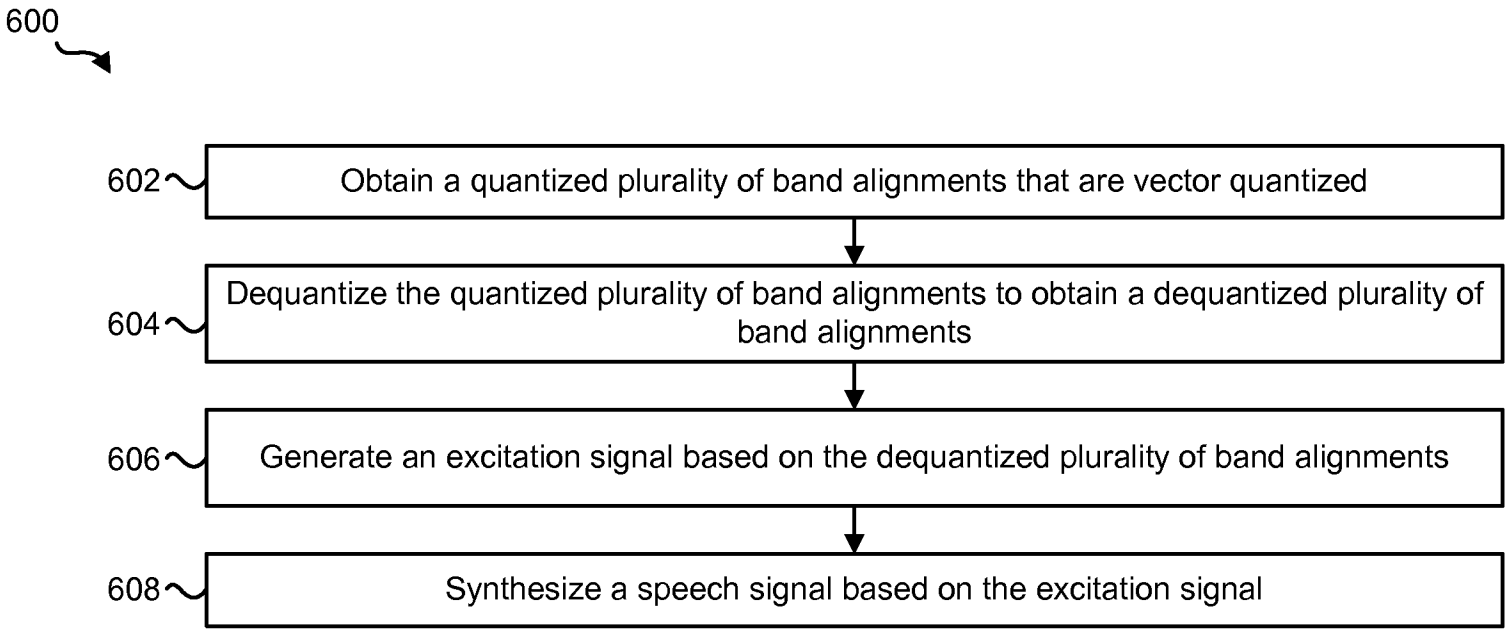
FIG. 6 is a flow diagram illustration one configuration of a method for dequantizing phase information.

FIG. 6 is a flow diagram illustration one configuration of a method 600 for dequantizing phase information. An electronic device 501 may obtain 602 a quantized plurality of band alignments 562 that are vector quantized. For example, the electronic device 501 may include a receiver that receives a bitstream from another electronic device. The bitstream may include the plurality of band alignments 562.

The electronic device 501 may dequantize 604 the quantized plurality of band alignments 562 to obtain a dequantized plurality of band alignments 525. For example, the electronic device 501 may look up dequantized band alignments 525 in a codebook or lookup table corresponding to the quantized band alignments 562 (e.g., an index) as described above in connection with FIG. 5. The quantized band alignments 562 may be vector-quantized band alignments 562. Accordingly, the electronic device 501 may apply vector dequantization to obtain the dequantized band alignments 525.

The electronic device 501 may generate 606 an excitation signal 531 based on the dequantized plurality of band alignments 525. For example, the PPP signal reconstruction and excitation signal generation module 529 may reconstruct a current PPP signal that is specified by the dequantized band alignments 525 and interpolate PPP signals between a previous frame PPP signal and the current frame PPP signal to generate the excitation signal 531 for the current frame as described above in connection with FIG. 5.

The electronic device 501 may synthesize 608 a speech signal (e.g., a decoded speech signal 515) based on the excitation signal 531. For example, the excitation signal 531 may be passed through a synthesis filter 513 to produce a synthesized speech signal as described above in connection with FIG. 5.

Figure 7:
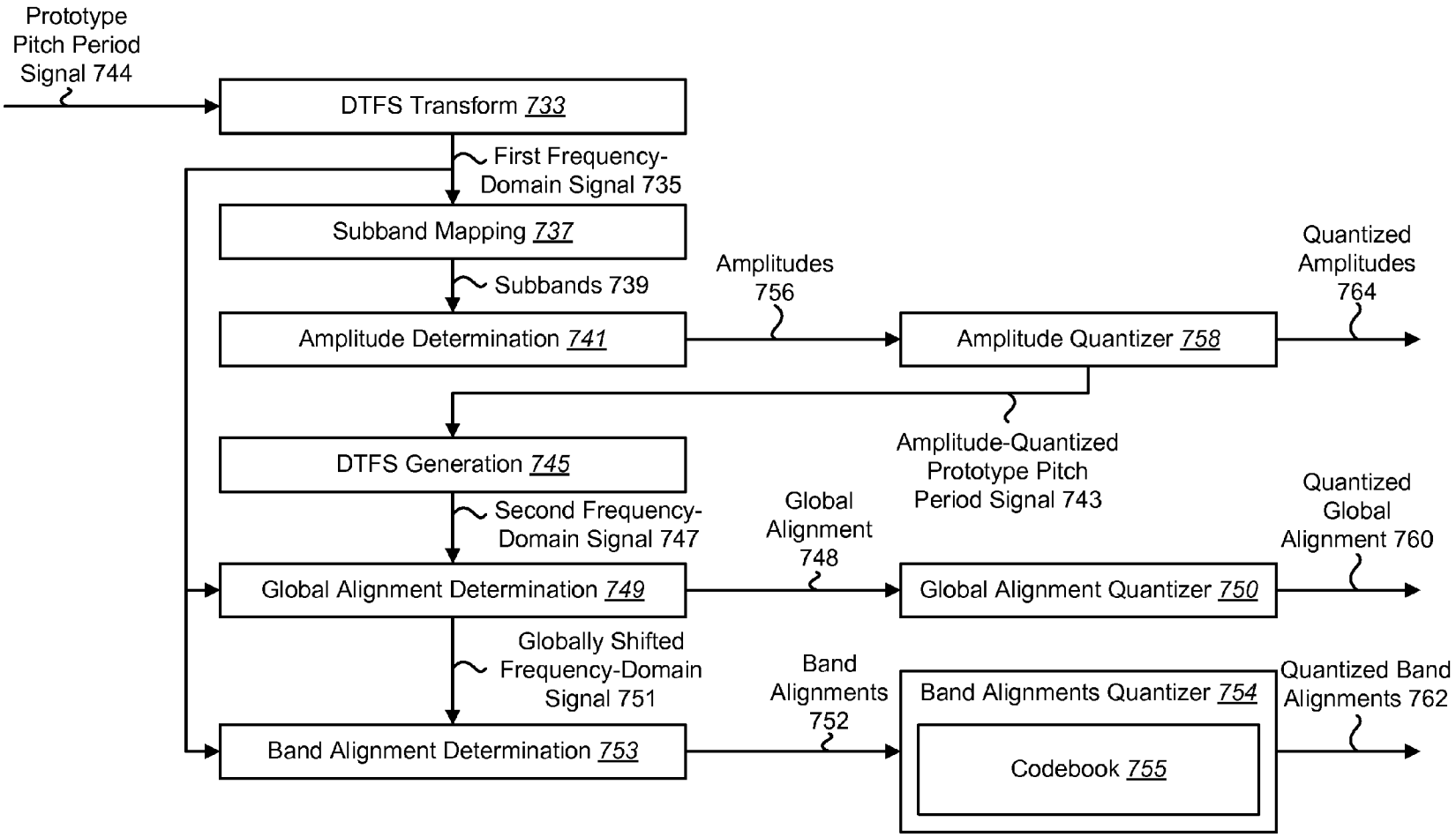
FIG. 7 is a block diagram illustrating one configuration of several modules that may be utilized for amplitude mapping and phase alignment searching.

FIG. 7 is a block diagram illustrating one configuration of several modules that may be utilized for amplitude mapping and phase alignment searching. In particular, FIG. 7 illustrates a more specific example of modules that may be utilized to perform functions described in connection with FIG. 3 and/or FIG. 4. FIG. 7 illustrates a DTFS transform 733, a subband mapping module 737, an amplitude determination module 741, a DTFS generation module 745, a global alignment determination module 749, a band alignment determination module 753, an amplitude quantizer 758, a global alignment quantizer 750 and/or a band alignments quantizer 754. One or more of the modules illustrated in FIG. 7 may be implemented in hardware, software or a combination of both. One or more of the modules illustrated in FIG. 7 may be implemented in an electronic device. In some configurations, one or more of the modules described in connection with FIG. 7 may be included within and/or correspond to one or more of the modules or components that perform similar functions as described in connection with FIG. 3.

The DTFS transform 733 may transform a PPP signal 744 into a first frequency-domain signal 735 (e.g., $X_T$). For example, the DTFS transform 733 may determine a DTFS of the PPP signal 744 as illustrated in Equation (1) above. The first frequency-domain signal 735 may be provided to the subband mapping module 737.

The subband mapping module 737 may map the first frequency-domain signal 735 (e.g., $X_T$) into a plurality of subbands 739. This may be accomplished as described in connection with FIG. 3. The plurality of subbands 739 may be provided to the amplitude determination module 741.

The amplitude determination module 741 may determine an amplitude 756 for each of the plurality of subbands 739. For example, the amplitude determination module 741 may average the first and last frequency index amplitudes of each subband 739 (that has two or more frequency indices, for instance) to produce the amplitude 756 for each subband 739. Alternatively, the amplitude determination module 741 may interpolate amplitudes neighboring the subband midpoint for one or more subbands to determine the amplitudes 756. It should be noted that the phase for each subband 739 may be discarded. For example, the phase for each subband may be set to 0. The amplitudes 756 may be provided to the amplitude quantizer 758.

The amplitude quantizer 758 may quantize the amplitudes 756 utilizing vector quantization to obtain quantized amplitudes 764 and an amplitude-quantized PPP signal 743. This may be accomplished as described above in connection with FIG. 3. The amplitude-quantized PPP signal 743 may be provided to the DTFS generation module 745.

The DTFS generation module 745 may determine a second frequency-domain signal 747 (e.g., $X_C$) based on the amplitude-quantized PPP signal 743. For example, the DTFS generation module 745 may generate the second frequency-domain signal 747 (e.g., $X_C$) as a DTFS with the same number of frequency indices as that of the first frequency-domain signal 735, where each frequency index has a phase of 0. Furthermore, the amplitudes of all frequency indices in each subband may be set to the (average) amplitude 756 for each subband. The second frequency-domain signal 747 may be provided to the global alignment determination module 749.

The global alignment determination module 749 may determine a global alignment 748 (e.g., $S_G$) based on the first frequency-domain signal 735 (e.g., $X_T$) and the second frequency domain signal 747 (e.g., $X_C$). For example, the global alignment determination module 749 may determine the global alignment 748 as a shift corresponding to the maximum correlation of the first frequency-domain signal 735 (e.g., $X_T$) and the second frequency-domain signal 747 (e.g., $X_C$). The global alignment 748 may be provided to the global alignment quantizer 750.

The global alignment determination module 749 may also determine a globally shifted frequency-domain signal 751 (e.g., $X_{GS}$). For example, the global alignment determination module 749 may multiply the second frequency-domain signal 747 by a factor (that is based on the global alignment 748 (e.g., $S_G$) in accordance with Equation (2) as described above. The globally shifted frequency-domain signal 751 may be provided to the band alignment determination module 753.

The band alignment determination module 753 may determine a plurality of band alignments 752 corresponding to the plurality of subbands 739. For example, the band alignment determination module 753 may determine a set of correlations between the globally shifted frequency-domain signal 751 (e.g., $X_{GS}$) and the first frequency domain signal 735 (e.g., $X_T$) within a single rotation around a unit circle for at least one of the plurality of subbands 739. The band alignment determination module 753 may also determine a band alignment corresponding to a maximum correlation for each set of correlations to determine the plurality of band alignments 752. For example, these operations may be accomplished as described above in connection with FIG. 3 as illustrated by Equation (4) and Equation (5). The plurality of band alignments 752 may be provided to the band alignment quantizer 754.

The band alignments quantizer 754 may quantize the plurality of band alignments 752 utilizing vector quantization to obtain a quantized plurality of band alignments 762. For example, the band alignments quantizer 754 may determine an index corresponding to a vector in a codebook 755 that best matches the band alignments 752. The quantized band alignments 762 may be the index to the codebook 755.

The global alignment quantizer 750 may quantize the global alignment 748 to produce a quantized global alignment 760. For example, the global alignment quantizer 750 may quantize the global alignment 748 utilizing scalar quantization to obtain the quantized global alignment 760 as described above in connection with FIG. 3.

Figure 8:
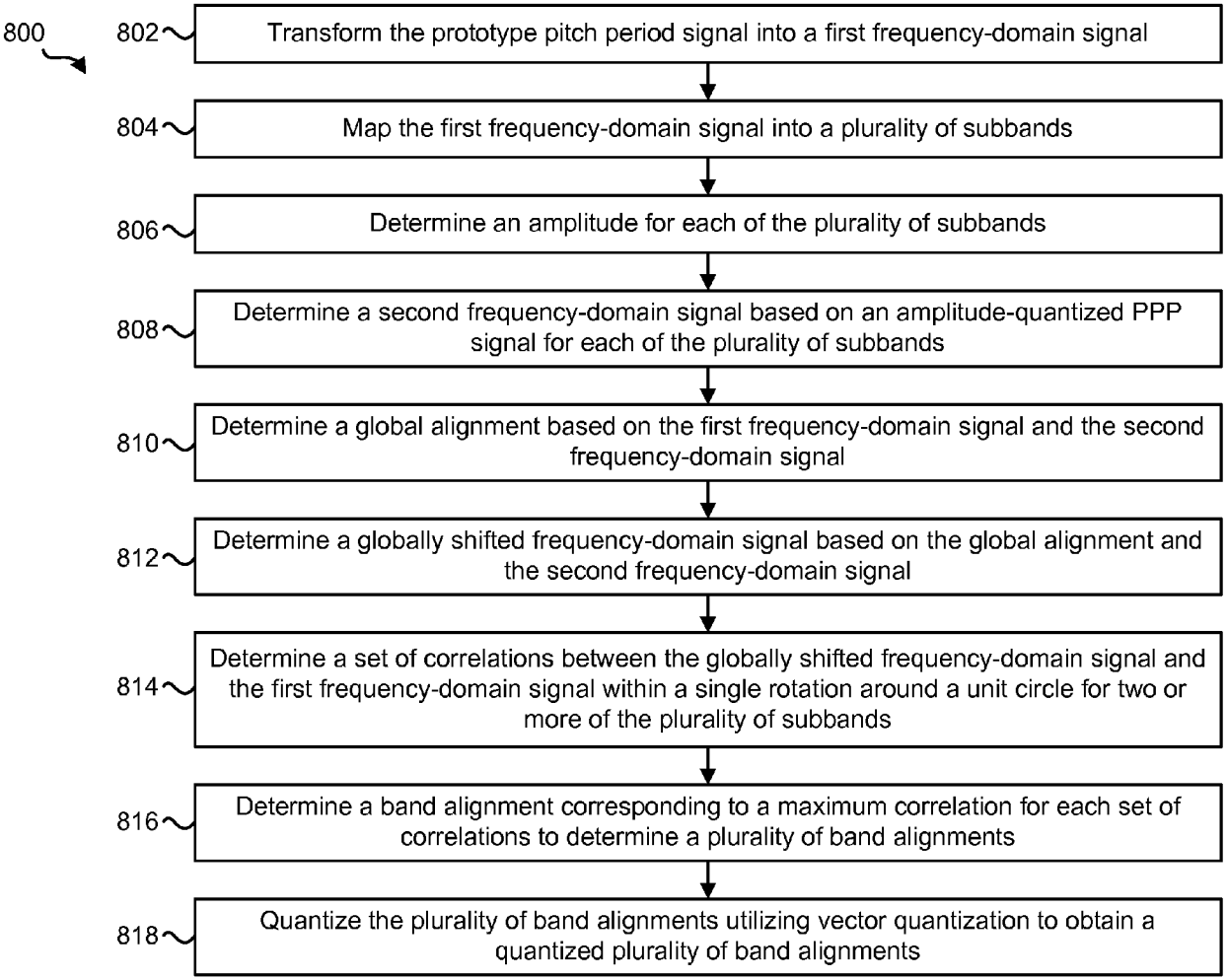
FIG. 8 is a flow diagram illustrating a more specific configuration of a method for quantizing phase information.

FIG. 8 is a flow diagram illustrating a more specific configuration of a method 800 for quantizing phase information. An electronic device may perform the method 800. For example, an electronic device that includes one or more of the modules described in connection with FIG. 7 may perform the method 800.

The electronic device may transform 802 a PPP signal 744 into a first frequency-domain signal 735 (e.g., $X_T$). For example, the DTFS transform 733 may determine a DTFS of the PPP signal 744 as illustrated in Equation (1) above. The electronic device may map 804 the first frequency-domain signal 735 (e.g., $X_T$) into a plurality of subbands 739. This may be accomplished as described in connection with FIG. 3 and/or FIG. 7.

The electronic device may determine 806 an amplitude 756 for each of the plurality of subbands 739. For example, determining 806 the amplitude for each of the plurality of subbands 739 may include determining the average amplitude of at least one frequency index of the first frequency-domain domain signal within at least one of the plurality of subbands. This may be accomplished as described above in connection with FIG. 3 and/or FIG. 7.

The electronic device may determine 808 a second frequency-domain signal 747 (e.g., $X_C$) based on the amplitude-quantized PPP signal 743 for each of the plurality of subbands, where the length of the second frequency-domain signal 747 is equal to the length of the first frequency-domain signal 735. This may be accomplished as described above in connection with FIG. 3 and/or FIG. 7.

The electronic device may determine 810 a global alignment 748 (e.g., $S_G$) based on the first frequency-domain signal 735 (e.g., $X_T$) and the second frequency domain signal 747 (e.g., $X_C$). For example, determining 810 the global alignment 748 may be based on a correlation between the first frequency-domain signal 735 and the second frequency-domain signal 747. This may be accomplished as described above in connection with FIG. 3 and/or FIG. 7. The electronic device may determine 812 a globally shifted frequency-domain signal 751 (e.g., $X_{GS}$). This may be accomplished as described above in connection with FIG. 3 and/or FIG. 7.

The electronic device may determine 814 a set of correlations between the globally shifted frequency-domain signal 751 (e.g., $X_{GS}$) and the first frequency domain signal 735 (e.g., $X_T$) within a single rotation around a unit circle for at least one of the plurality of subbands 739. This may be accomplished as described above in connection with FIG. 3 and/or FIG. 7. The electronic device may determine 816 a band alignment corresponding to a maximum correlation for each set of correlations to determine the plurality of band alignments 752. This may be accomplished as described above in connection with FIG. 3 and/or FIG. 7.

The electronic device may quantize 818 the plurality of band alignments 752 utilizing vector quantization to obtain a quantized plurality of band alignments 762. This may be accomplished as described above in connection with FIG. 3 or FIG. 7.

Figure 10:
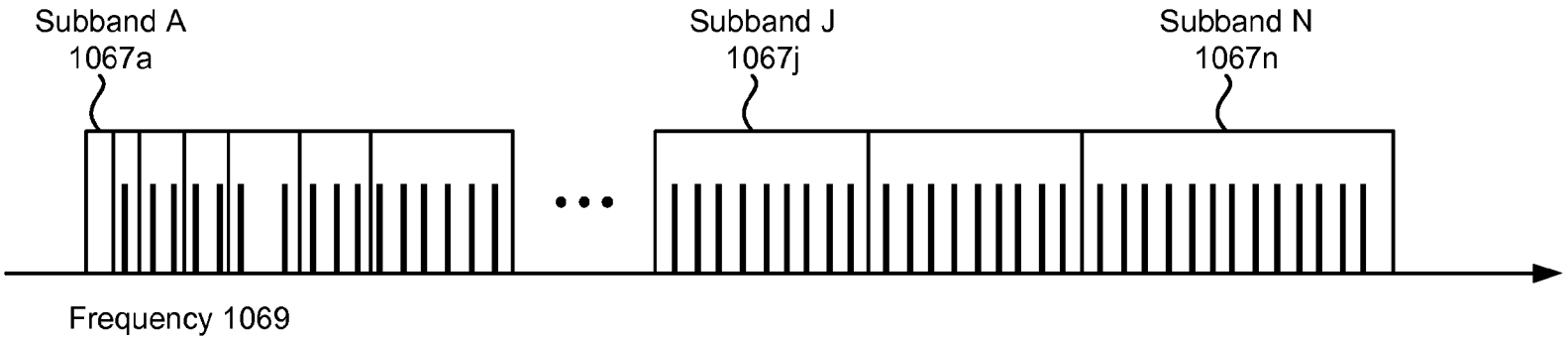
FIG. 10 is a diagram that illustrates an example of mapping a first frequency-domain signal to non-uniform subbands.
Figure 11:
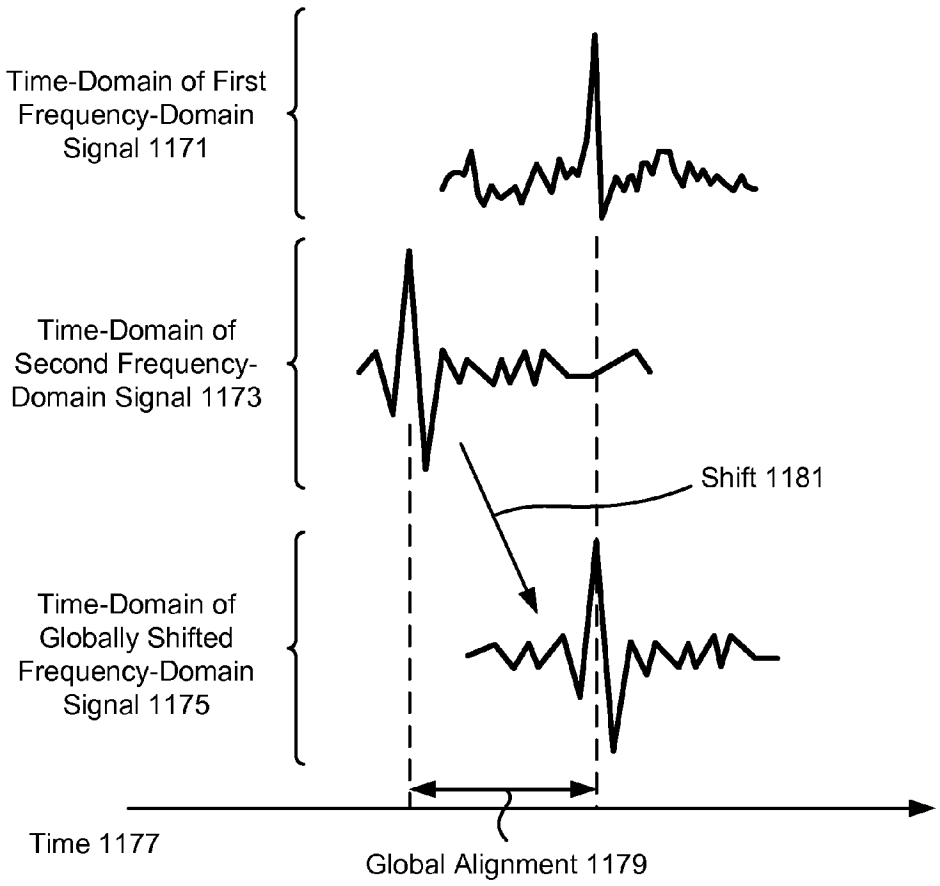
FIG. 11 is a diagram that illustrates one example of a global alignment.

For ease of understanding, examples are given hereafter to illustrate operations for determining a global alignment. In particular, FIGS. 9-11 illustrate examples of operations for determining a global alignment.

Figure 9:
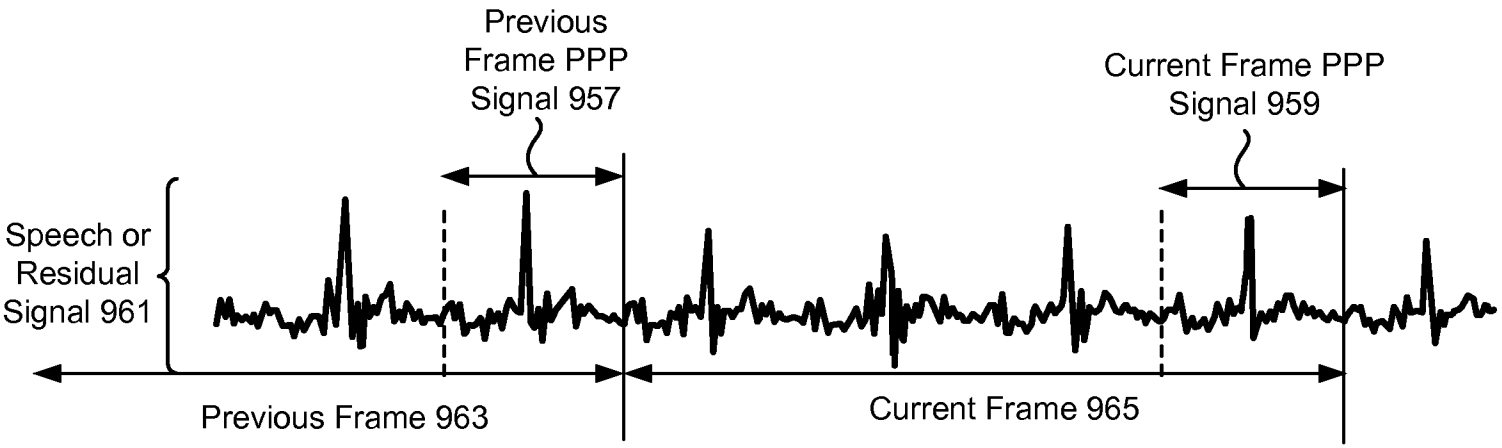
FIG. 9 is a graph illustrating one example of a speech or residual signal.

FIG. 9 is a graph illustrating one example of a speech or residual signal 961. In particular, FIG. 9 illustrates a previous frame 963 and a current frame 965 of the speech or residual signal 961. The speech or residual signal 961 is a voiced signal and accordingly exhibits periodic pitch cycles. An encoder 304 may determine (e.g., extract) PPP signals from a speech or residual signal 961. For example, an encoder 304 may determine a pitch lag (e.g., L) and pitch cycle boundaries. The encoder 304 may then designate the last pitch cycle of each frame as a PPP signal (e.g., x(m)). For instance, the encoder 304 may obtain a previous frame PPP signal 957

(e.g., the last PPP signal of a previous frame 963) and a current frame PPP signal 959 (e.g., the last PPP signal of a current frame).

Once the current frame PPP signal 959 (e.g., x(m)) is determined, the encoder 304 may determine a DTFS of the current frame PPP signal 959 to determine a first frequency-domain signal (e.g., $X_T$). This may be accomplished in accordance with Equation (1) as described above. The first frequency-domain signal (e.g., $X_T(i)$) may have the same length (e.g., L) as current frame PPP signal 959, which is the pitch lag of the current frame and may be referred to as the "target PPP signal." For purposes of this example, it may be assumed that L=44. Each frequency index (of $X_T$, for example) has an amplitude and phase. It should be noted that EVRC specifications also use a DTFS.

FIG. 10 is a diagram that illustrates an example of mapping the first frequency-domain signal (e.g., $X_T$) to non-uniform subbands 1067*a-n*. For example, the encoder 304 may map the first frequency-domain signal from the DTFS domain into the subband domain. In this example, the number of subbands 1067 is 24. As illustrated in FIG. 10, higher subbands (e.g., subband N 1067*n*) have wider bandwidths in frequency 1069 and include more frequency indices of the first frequency-domain signal than lower subbands (e.g., subband A 1067*a* and subband J 1067*j*). The mapping utilized may be predetermined based on the length (e.g., L) of the first frequency-domain signal.

As described above, the encoder 304 may determine an amplitude for each subband 1067 based on one or more frequency indices included in each subband 1067 of the first frequency-domain signal. For example, the amplitude for subbands 1067 with two or more frequency indices may be the average amplitude of the first and last frequency indices in the subband 1067. The phase for each subband 1067 may be discarded (e.g., set to 0). These operations may be performed in the subband domain.

FIG. 11 is a diagram that illustrates one example of a global alignment 1179. In particular, FIG. 11 illustrates one example of the time-domain version of the first frequency-domain signal 1171 (e.g., $X_T$) over time 1177. As described above, the encoder 304 may generate a second frequency-domain signal (e.g., $X_C(i)$, where $0 \le i < L$) in the DTFS domain based on the amplitude of each subband 1067 (in the subband domain). In this example, the phase for all 44 frequency indices of the second frequency-domain signal is 0. The amplitude for each of the frequency indices in the same subband 1067 of the second frequency-domain signal is the same. FIG. 11 illustrates one example of the time-domain version of the second frequency-domain signal 1173. For example, the time-domain version of $X_C$ 1173 may be similar to a shifted version of a time-domain version of $X_T$ 1171. This is because phase information has been discarded in $X_C$. Aside from the phase difference, both waveforms 1171, 1173 do not look identical because the amplitudes for each of the subbands are the averaged amplitudes from $X_T$.

As described above, the encoder 304 may determine a global alignment 1179 (e.g., $S_G$). For example, the encoder 304 may determine the global alignment 1179 by calculating the index that creates the maximum correlation between the first frequency-domain signal (e.g., $X_T$) and the second frequency-domain signal (e.g., $X_C$). It should be noted that anticipated Enhanced Voice Services (EVS) specifications may utilize a frequency-domain correlation to save computational complexity, although this is analogous to calculating the correlation of two time-domain waveforms. Additionally, the correlation may be calculated in the frequency domain since a relative phase difference for each subband is missing.

FIG. 11 illustrates one example of a time-domain version of the globally shifted frequency-domain signal 1175, which is illustrated as a phase-shifted version of the time-domain version of the second frequency-domain signal 1173. The phase shift 1181 that gives the maximum correlation between the time-domain version of the first frequency-domain signal 1171 and the shifted version of the time-domain version of the second frequency-domain signal 1173 is the global alignment 1179. The global alignment 1179 may be quantized and stored (e.g., sent) in a bitstream.

As described above, the electronic device 396 may determine a globally shifted frequency-domain signal (e.g., $X_{GS}(i)$, where $0 \le i < L$) by multiplying the second frequency-domain signal by a factor in accordance with Equation (2). The globally shifted frequency-domain signal is the second frequency-domain signal shifted by the quantized global alignment (e.g., $S_{GQ}$). As illustrated in FIG. 11, multiplying a linear phase in the frequency domain is equivalent to a circular shift in the time domain. Once the electronic device 396 has determined and applied the global alignment, the electronic device may determine band alignments 352 (e.g., band_alignment(j) for each subband to enable multi-band phase alignment).

Figure 12:
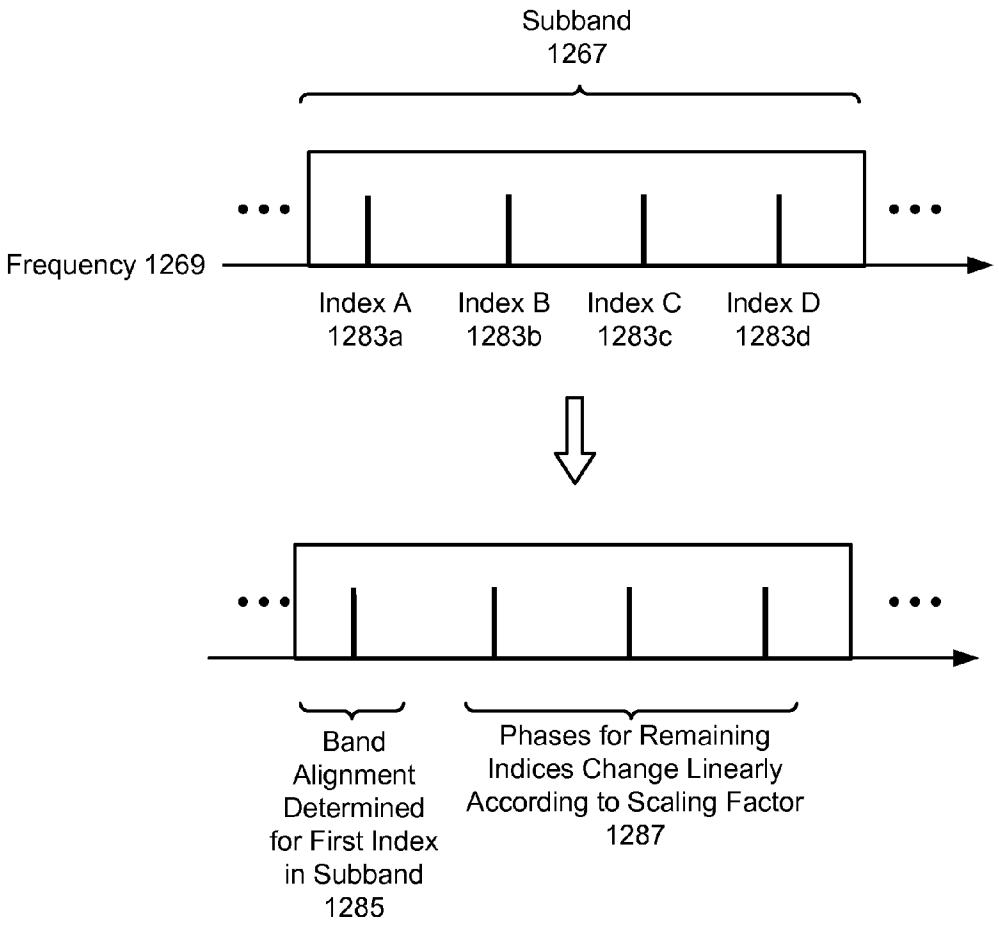
FIG. 12 is a diagram that illustrates one example of band alignment for a subband.

FIG. 12 is a diagram that illustrates one example of band alignment for a subband 1267. In particular, FIG. 12 illustrates a subband 1267 over frequency 1269 that includes four frequency indices 1283*a-d*. The electronic device 396 may determine a plurality of band alignments 352 corresponding to the plurality of subbands. Each band alignment 352 may be a phase shift for the first frequency index in each subband of the globally shifted frequency domain-signal (e.g., $X_{GS}$). For instance, a band alignment may be determined 1285 for the first index (e.g., index A 1283*a*) in the subband 1267. A known approach (e.g., EVRC specifications) allows multiple rotations around a unit circle in searching for a band alignment. In some cases, this results in a lower-resolution search with multiple rotations around the unit circle. In contrast, the systems and methods disclosed herein only allow a single rotation around the unit circle in searching for a band alignment. In some cases, this results in a higher-resolution search with only a single rotation around the unit circle.

Once the band alignment index n that maximizes the correlation between the globally shifted frequency domain-signal (e.g., $X_{GS}$) and the first frequency-domain signal (e.g., $X_T$) is determined for a subband 1267, the scaling factor $$\frac{k+1}{k_{ib}+1}$$

ensures that the band alignment angle $\hat{\Theta}$ changes linearly for the rest of the frequency indices (e.g., DTFS components) included in the given subband 1267. For example, assume that the subband 1267 is subband 10 (e.g., j=10) and has four frequency indices (e.g., indices A-D 1283*a-d* at indices 20-23). Also assume that there are a total of 32 different possible band alignment indices (with a 5-bit index, for example). Once the band alignment for index A 1283*a* is determined, then the phases of the remaining frequency indices (e.g., indices B-D 1283*b-d*) will be linearly changing 1287 according to the scaling factor.

Figure 13:
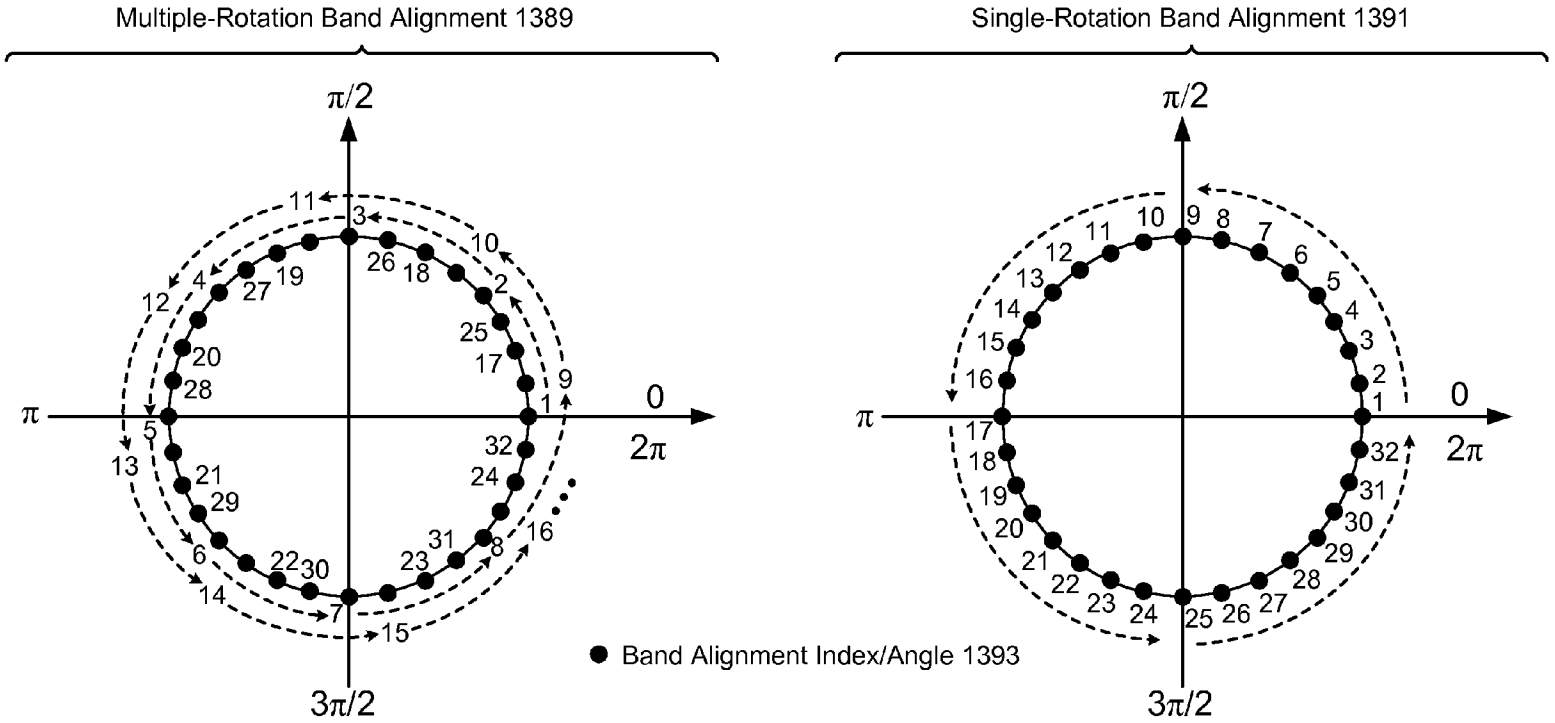
FIG. 13 is a diagram illustrating one example of multiple-rotation band alignment and one example of single-rotation band alignment in accordance with the systems and methods disclosed herein.

FIG. 13 is a diagram illustrating one example of multiple-rotation band alignment 1389 and one example of single-rotation band alignment 1391 in accordance with the systems and methods disclosed herein. In particular, several band alignment indices or angles 1393 are illustrated corresponding to the multiple-rotation band alignment 1389 and the single-rotation band alignment 1391.

Some band alignment search schemes may include searching a unit circle for multiple rotations. This may generate an indexing histogram having multiple peaks. For example, the multiple-rotation band alignment 1389 includes band alignment indices/angles 1393 that rotate around the unit circle multiple times as denoted by the numeric sequence on the unit circle.

The band alignment search scheme in accordance with the systems and methods disclosed herein (which may be incorporated into anticipated EVS specifications) provides searching the unit circle in a single rotation. This may generate an indexing histogram with a distribution similar to a Gaussian distribution. For example, the single-rotation band alignment 1391 includes band alignment indices/angles 1393 that rotate around the unit circle only once as denoted by the numeric sequence on the unit circle. This allows vector quantization, which reduces the number of required bits to about 64 bits (e.g., about a 40% bit savings over EVRC specifications).

Figure 13A:
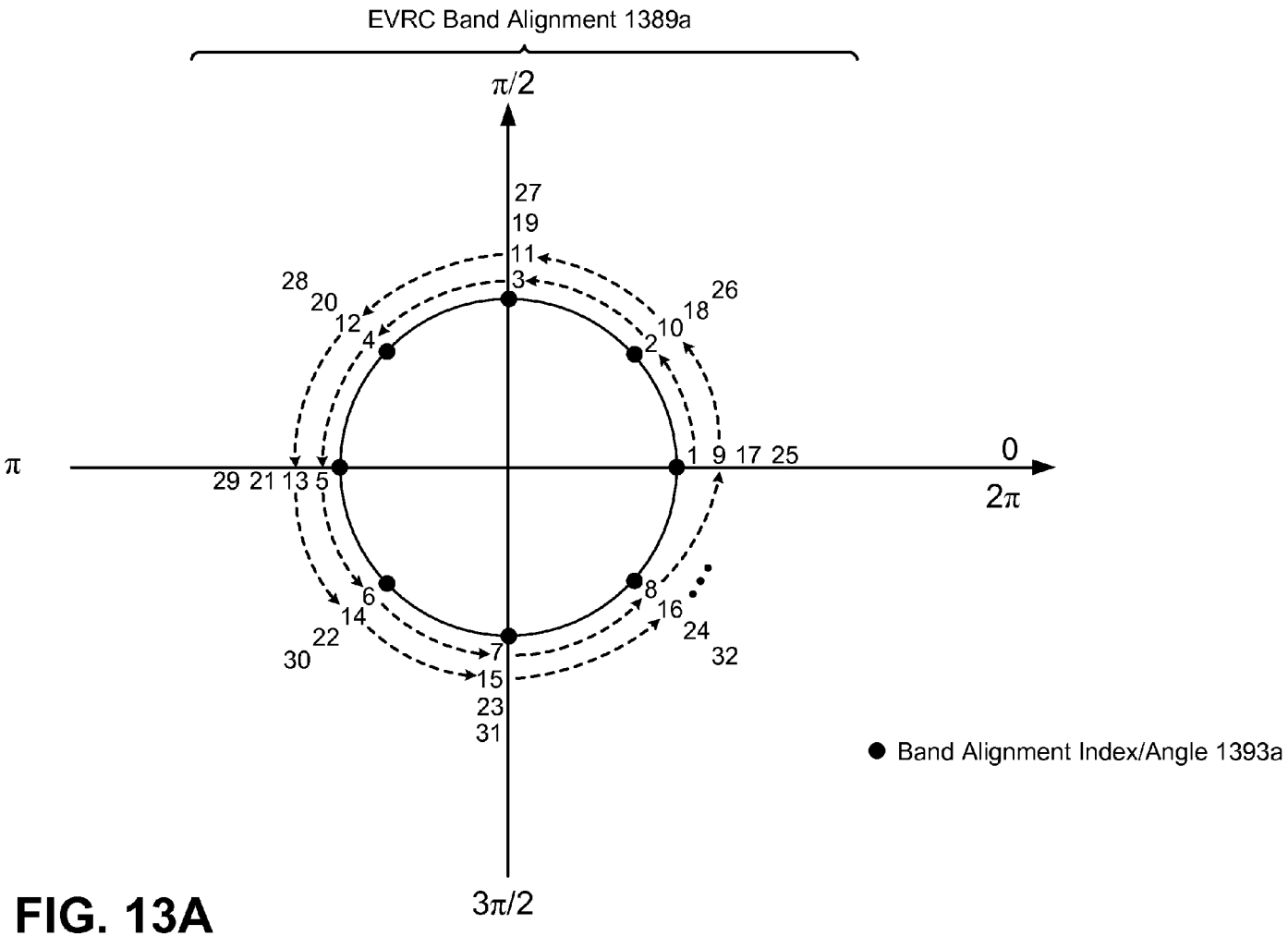
FIG. 13A is a diagram illustrating one example of Enhanced Variable Rate Codec (EVRC) band alignment.

FIG. 13A is a diagram illustrating one example of EVRC band alignment 1389*a*. In particular, several band alignment indices or angles 1393*a* are illustrated corresponding to the EVRC band alignment 1389*a*.

The band alignment search scheme in accordance with EVRC specifications may include searching a unit circle for multiple rotations with lower resolution. This may generate an indexing histogram having multiple peaks. For example, the EVRC band alignment 1389*a* includes band alignment indices/angles 1393*a* that rotate around the unit circle multiple times as denoted by the numeric sequence on the unit circle. As illustrated in FIG. 13A, band alignment searching in accordance with EVRC specifications may repeatedly cover the same angles while rotating around the unit circle multiple times. In this example, the band alignment search repeatedly covers angles $$0, \frac{\pi}{4}, \frac{\pi}{2}, \frac{3\pi}{4}, \pi, \frac{5\pi}{4}, \frac{3\pi}{2}, \text{and } \frac{7\pi}{4}$$

as described above. EVRC specifications utilize scalar quantization for band alignment, which requires about 100 bits (e.g., 5 bits each for 20 subbands). This provides 32 possible band alignments for each subband. In comparison, the band alignment search scheme in accordance with the systems and methods disclosed herein provides searching the unit circle in a single rotation, typically with higher resolution.

Figure 14:
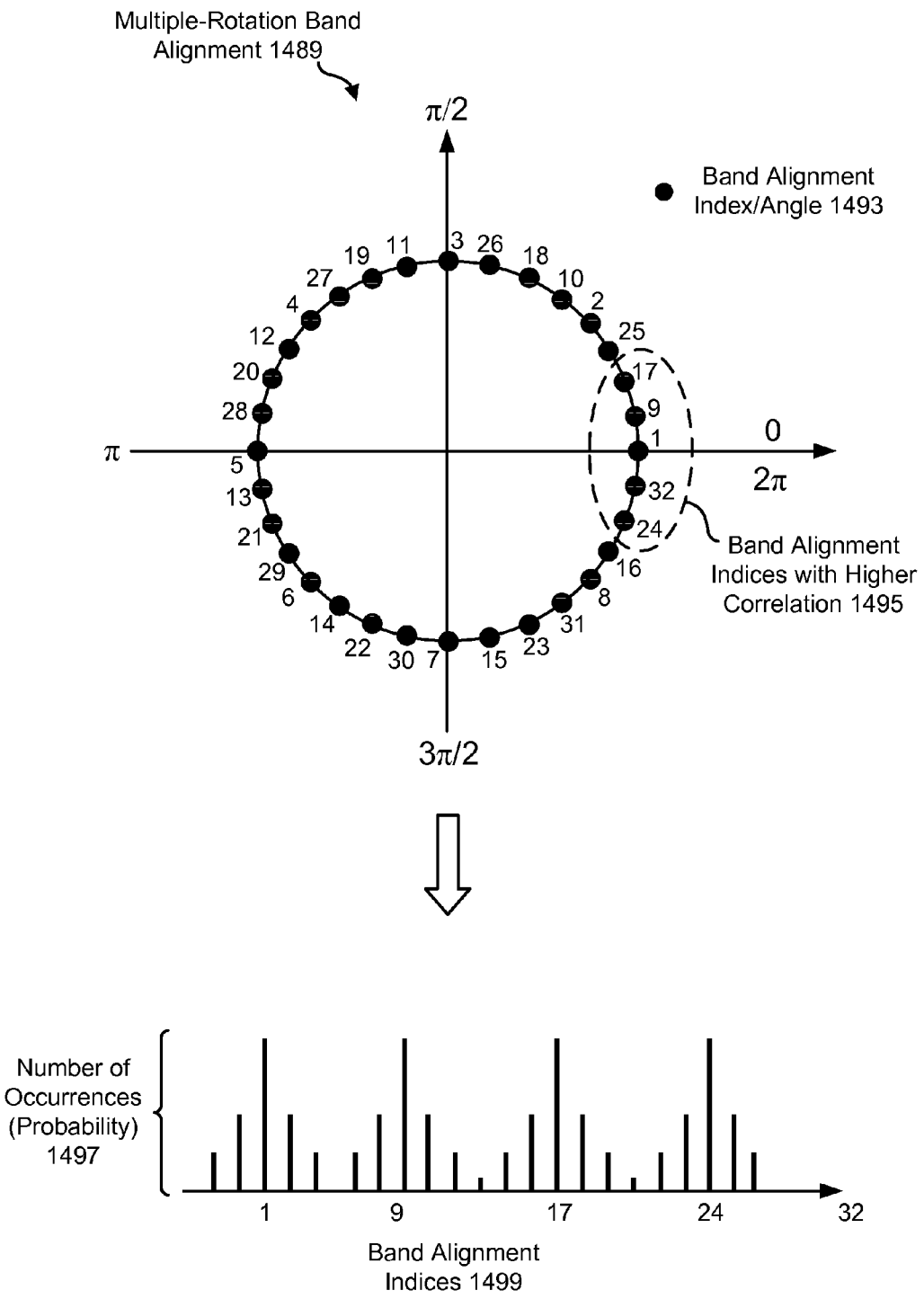
FIG. 14 is a diagram that illustrates a more specific example of multiple-rotation band alignment.

FIG. 14 is a diagram that illustrates a more specific example of multiple-rotation band alignment 1489. In this example, the band alignment indices/angles 1493 rotate around the unit circle multiple times as denoted by the numeric sequence on the unit circle. In this example, assume that band alignment indices with a higher correlation 1495 (between the first frequency-domain signal and the second frequency-domain signal, for instance) occur in the region indicated around 0 (radians) of the unit circle. As illustrated in FIG. 14, multiple peaks occur in the number of occurrences (probability) 1497 over the band alignment indices 1499. In particular, FIG. 14 shows an example band alignment index distribution for a particular harmonic number. This is one example of a typical case where band alignments are centered around 0. The band alignment index distribution (e.g., histogram of the alignments) includes four peaks around band indices 1, 9, 17 and 24. This makes the quantization inefficient and the advantages of vector quantization techniques cannot be fully utilized in this case.

Figure 15:
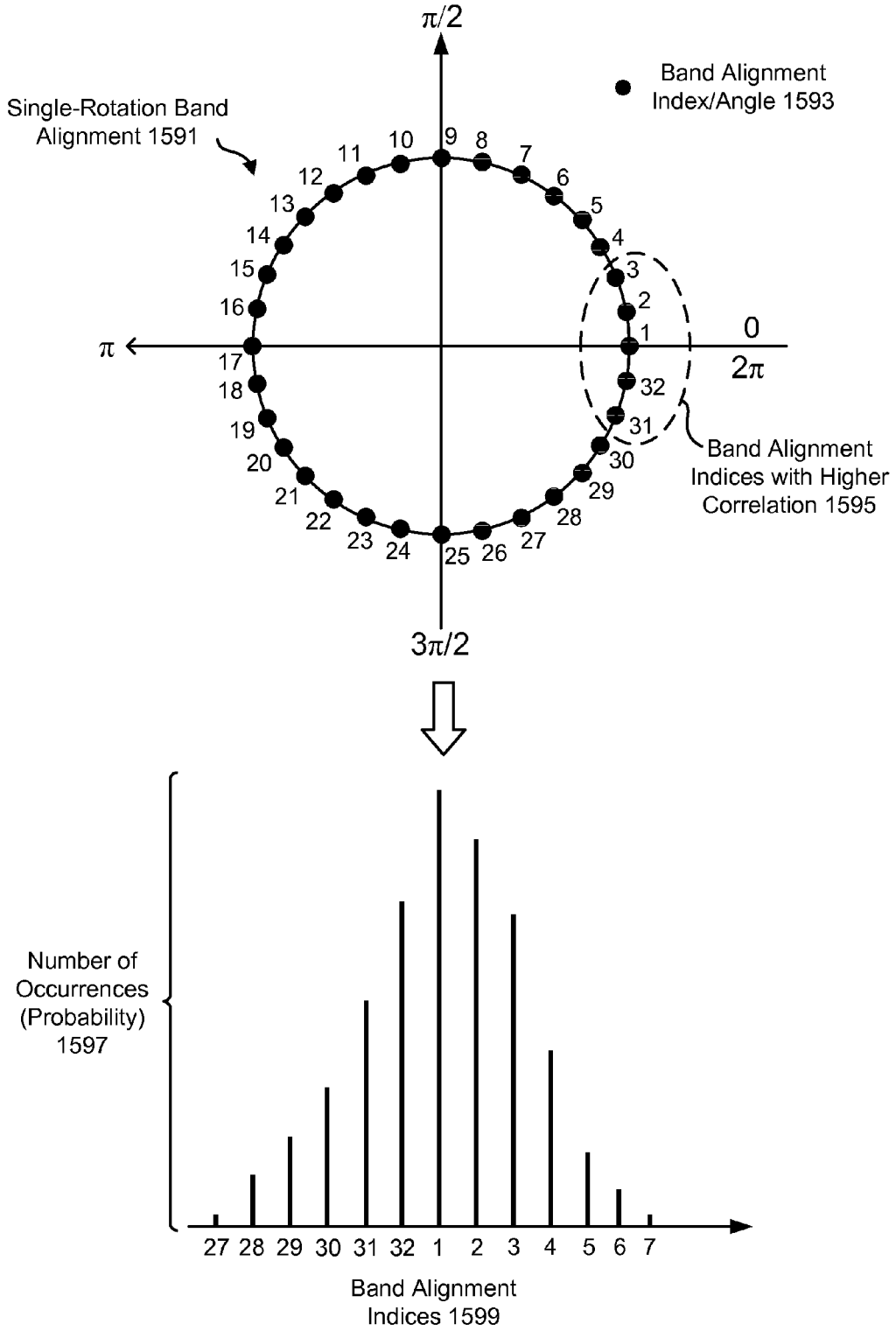
FIG. 15 is a diagram that illustrates a more specific example of single-rotation band alignment.

FIG. 15 is a diagram that illustrates a more specific example of single-rotation band alignment 1591. In this example, the band alignment indices/angles 1593 rotate around the unit circle only once as denoted by the numeric sequence on the unit circle. In this example, assume that band alignment indices with higher correlation 1595 (between the first frequency-domain signal and the second frequency-domain signal, for instance) occur around 0. As illustrated in FIG. 15, a single peak occurs in the number of occurrences (probability) 1597 over the band alignment indices 1599 (once the indices are ordered as shown in FIG. 15). In particular, FIG. 15 shows an example band alignment index distribution for a particular harmonic number. In this example, the quantization indices are arranged such that the indices distribution will look like a Gaussian distribution. Alternatively, the range of n of Equation (5) could be defined as $$n = \left\{-\frac{(N-1)}{2}, \ldots, +\left\lfloor \frac{N}{2} \right\rfloor\right\}$$

such that the peak of the distribution occurs around 0. This alternative search also results in the same search angles where the search indices n are rearranged.

The distribution of the alignment indices for known band alignment schemes may be similar to the histogram provided in FIG. 14. In the known approach, the quantization codebook has to allocate more codepoints to every peak instead of allocating more points to a single peak, which is the case in the approach provided in accordance with the systems and methods disclosed herein (as illustrated in the histogram in FIG. 15, for example). Thus, the systems and methods disclosed herein may produce more efficient quantization with less distortion.

Figure 16:
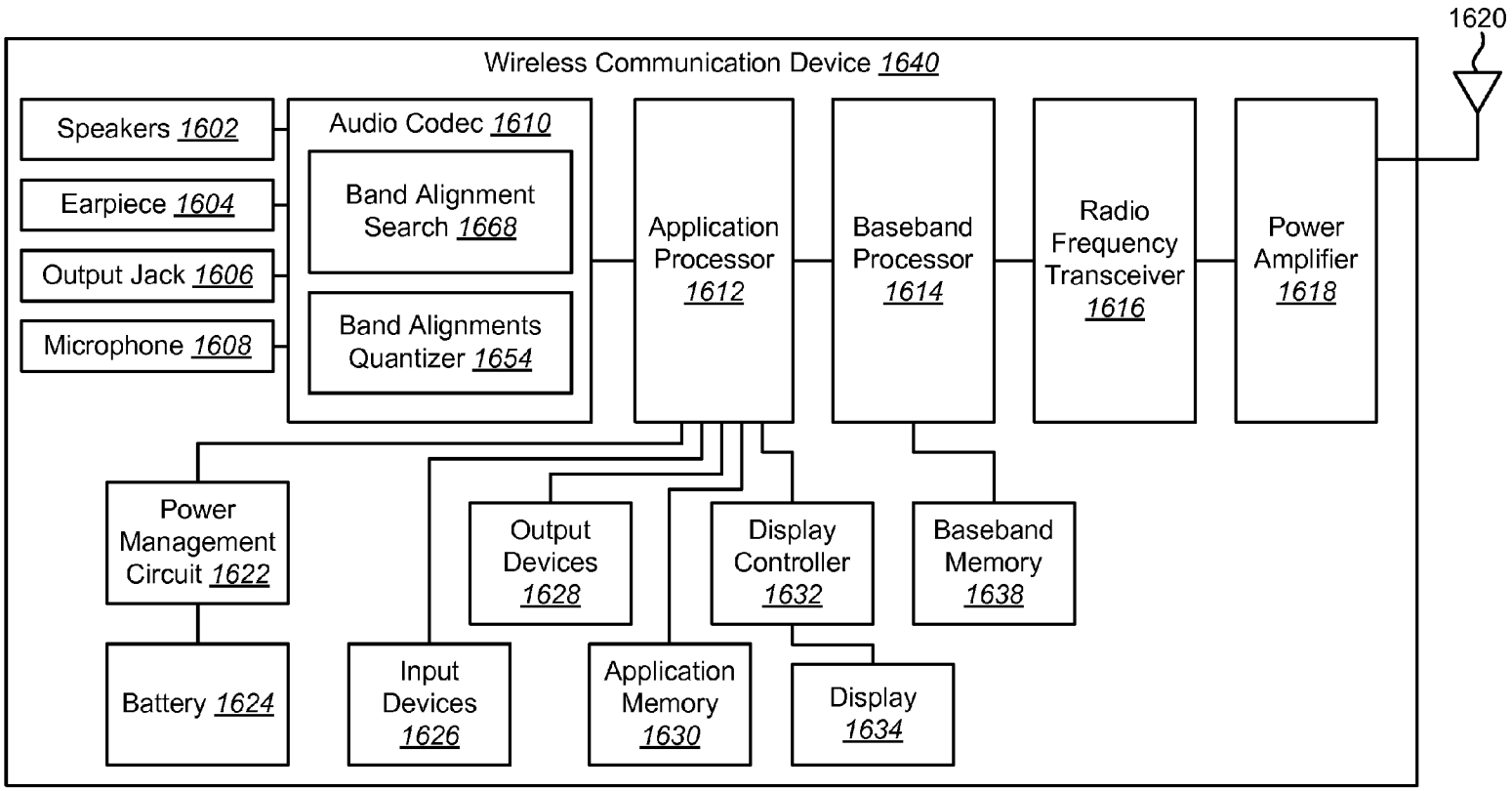
FIG. 16 is a block diagram illustrating one configuration of a wireless communication device in which systems and methods for quantizing and dequantizing phase information may be implemented.

FIG. 16 is a block diagram illustrating one configuration of a wireless communication device 1640 in which systems and methods for quantizing and dequantizing phase information may be implemented. The wireless communication device 1640 illustrated in FIG. 16 may be an example of at least one of the electronic devices described herein. The wireless communication device 1640 may include an application processor 1612. The application processor 1612 generally processes instructions (e.g., runs programs) to perform functions on the wireless communication device 1640. The application processor 1612 may be coupled to an audio coder/decoder (codec) 1610.

The audio codec 1610 may be used for coding and/or decoding audio signals. The audio codec 1610 may be coupled to at least one speaker 1602, an earpiece 1604, an output jack 1606 and/or at least one microphone 1608. The speakers 1602 may include one or more electro-acoustic transducers that convert electrical or electronic signals into acoustic signals. For example, the speakers 1602 may be used to play music or output a speakerphone conversation, etc. The earpiece 1604 may be another speaker or electro-acoustic transducer that can be used to output acoustic signals (e.g., speech signals) to a user. For example, the earpiece 1604 may be used such that only a user may reliably hear the acoustic signal. The output jack 1606 may be used for coupling other devices to the wireless communication device 1640 for outputting audio, such as headphones. The speakers 1602, earpiece 1604 and/or output jack 1606 may generally be used for outputting an audio signal from the audio codec 1610. The at least one microphone 1608 may be an acousto-electric transducer that converts an acoustic signal (such as a user's voice) into electrical or electronic signals that are provided to the audio codec 1610.

The audio codec 1610 (e.g., a decoder) may include a band alignment search module 1668 and/or a band alignments quantizer 1654. The band alignment search module 1668 may determine band alignments as described above. The band alignments quantizer 1654 may quantize band alignments as described above.

The application processor 1612 may also be coupled to a power management circuit 1622. One example of a power management circuit 1622 is a power management integrated circuit (PMIC), which may be used to manage the electrical power consumption of the wireless communication device 1640. The power management circuit 1622 may be coupled to a battery 1624. The battery 1624 may generally provide electrical power to the wireless communication device 1640. For example, the battery 1624 and/or the power management circuit 1622 may be coupled to at least one of the elements included in the wireless communication device 1640.

The application processor 1612 may be coupled to at least one input device 1626 for receiving input. Examples of input devices 1626 include infrared sensors, image sensors, accelerometers, touch sensors, keypads, etc. The input devices 1626 may allow user interaction with the wireless communication device 1640. The application processor 1612 may also be coupled to one or more output devices 1628. Examples of output devices 1628 include printers, projectors, screens, haptic devices, etc. The output devices 1628 may allow the wireless communication device 1640 to produce output that may be experienced by a user.

The application processor 1612 may be coupled to application memory 1630. The application memory 1630 may be any electronic device that is capable of storing electronic information. Examples of application memory 1630 include double data rate synchronous dynamic random access memory (DDRAM), synchronous dynamic random access memory (SDRAM), flash memory, etc. The application memory 1630 may provide storage for the application processor 1612. For instance, the application memory 1630 may store data and/or instructions for the functioning of programs that are run on the application processor 1612.

The application processor 1612 may be coupled to a display controller 1632, which in turn may be coupled to a display 1634. The display controller 1632 may be a hardware block that is used to generate images on the display 1634. For example, the display controller 1632 may translate instructions and/or data from the application processor 1612 into images that can be presented on the display 1634. Examples of the display 1634 include liquid crystal display (LCD) panels, light emitting diode (LED) panels, cathode ray tube (CRT) displays, plasma displays, etc.

The application processor 1612 may be coupled to a baseband processor 1614. The baseband processor 1614 generally processes communication signals. For example, the baseband processor 1614 may demodulate and/or decode received signals. Additionally or alternatively, the baseband processor 1614 may encode and/or modulate signals in preparation for transmission.

The baseband processor 1614 may be coupled to baseband memory 1638. The baseband memory 1638 may be any electronic device capable of storing electronic information, such as SDRAM, DDRAM, flash memory, etc. The baseband processor 1614 may read information (e.g., instructions and/or data) from and/or write information to the baseband memory 1638. Additionally or alternatively, the baseband processor 1614 may use instructions and/or data stored in the baseband memory 1638 to perform communication operations.

The baseband processor 1614 may be coupled to a radio frequency (RF) transceiver 1616. The RF transceiver 1616 may be coupled to a power amplifier 1618 and one or more antennas 1620. The RF transceiver 1616 may transmit and/or receive radio frequency signals. For example, the RF transceiver 1616 may transmit an RF signal using a power amplifier 1618 and at least one antenna 1620. The RF transceiver 1616 may also receive RF signals using the one or more antennas 1620.

Figure 17:
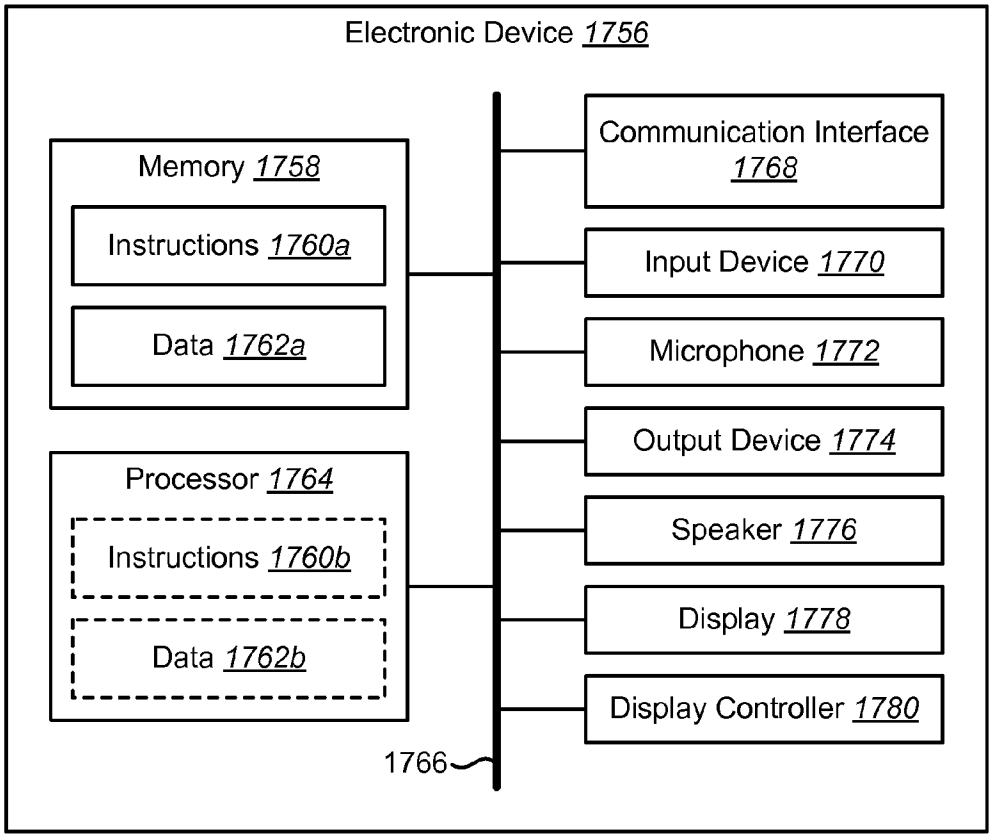
FIG. 17 illustrates various components that may be utilized in an electronic device.

FIG. 17 illustrates various components that may be utilized in an electronic device 1756. The illustrated components may be located within the same physical structure or in separate housings or structures. The electronic device 1756 described in connection with FIG. 17 may be implemented in accordance with one or more of the electronic devices described herein. The electronic device 1756 includes a processor 1764. The processor 1764 may be a general purpose single- or multi-chip microprocessor (e.g., an ARM), a special purpose microprocessor (e.g., a digital signal processor (DSP)), a microcontroller, a programmable gate array, etc. The processor 1764 may be referred to as a central processing unit (CPU). Although just a single processor 1764 is shown in the electronic device 1756 of FIG. 17, in an alternative configuration, a combination of processors (e.g., an ARM and DSP) could be used.

The electronic device 1756 also includes memory 1758 in electronic communication with the processor 1764. That is, the processor 1764 can read information from and/or write information to the memory 1758. The memory 1758 may be any electronic component capable of storing electronic information. The memory 1758 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1762*a* and instructions 1760*a* may be stored in the memory 1758. The instructions 1760*a* may include one or more programs, routines, sub-routines, functions, procedures, etc. The instructions 1760*a* may include a single computer-readable statement or many computer-readable statements. The instructions 1760*a* may be executable by the processor 1764 to implement one or more of the methods, functions and procedures described above. Executing the instructions 1760*a* may involve the use of the data 1762*a* that is stored in the memory 1758. FIG. 17 shows some instructions 1760*b* and data 1762*b* being loaded into the processor 1764 (which may come from instructions 1760*a* and data 1762*a*).

The electronic device 1756 may also include one or more communication interfaces 1768 for communicating with other electronic devices. The communication interfaces 1768 may be based on wired communication technology, wireless communication technology, or both. Examples of different types of communication interfaces 1768 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1756 may also include one or more input devices 1770 and one or more output devices 1774. Examples of different kinds of input devices 1770 include a keyboard, mouse, microphone, remote control device, button, joystick, trackball, touchpad, lightpen, etc. For instance, the electronic device 1756 may include one or more microphones 1772 for capturing acoustic signals. In one configuration, a microphone 1772 may be a transducer that converts acoustic signals (e.g., voice, speech) into electrical or electronic signals. Examples of different kinds of output devices 1774 include a speaker, printer, etc. For instance, the electronic device 1756 may include one or more speakers 1776. In one configuration, a speaker 1776 may be a transducer that converts electrical or electronic signals into acoustic signals. One specific type of output device which may be typically included in an electronic device 1756 is a display device 1778. Display devices 1778 used with configurations disclosed herein may utilize any suitable image projection technology, such as a cathode ray tube (CRT), liquid crystal display (LCD), light-emitting diode (LED), gas plasma, electroluminescence, or the like. A display controller 1780 may also be provided for converting data stored in the memory 1758 into text, graphics, and/or moving images (as appropriate) shown on the display device 1778.

The various components of the electronic device 1756 may be coupled together by one or more buses, which may include a power bus, a control signal bus, a status signal bus, a data bus, etc. For simplicity, the various buses are illustrated in FIG. 17 as a bus system 1766. It should be noted that FIG. 17 illustrates only one possible configuration of an electronic device 1756. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for quantizing phase information on an electronic device, comprising:

obtaining a speech signal;

determining a prototype pitch period signal based on the speech signal;

transforming the prototype pitch period signal into a first frequency-domain signal;

mapping the first frequency-domain signal into a plurality of subbands;

determining a global alignment based on the first frequency-domain signal;

quantizing the global alignment utilizing scalar quantization to obtain a quantized global alignment;

determining a plurality of band alignments corresponding to the plurality of subbands;

quantizing the plurality of band alignments utilizing vector quantization to obtain a quantized plurality of band alignments; and transmitting the quantized global alignment and the quantized plurality of band alignments.

2. The method of claim 1, further comprising:

determining an amplitude for each of the plurality of subbands; and determining a second frequency-domain signal based on an amplitude-quantized prototype pitch period signal, wherein a length of the second frequency-domain signal is equal to a length of the first frequency-domain signal, and wherein determining the global alignment is based on a correlation between the first frequency-domain signal and the second frequency-domain signal.

3. The method of claim 2, wherein determining the amplitude for each of the plurality of subbands comprises determining an average amplitude of at least one frequency index of the first frequency-domain signal within at least one of the plurality of subbands.

4. The method of claim 3, wherein the average amplitude of a subband with two or more frequency indices is an average amplitude of first and last frequency indices in the subband.

5. The method of claim 2, wherein determining the plurality of band alignments corresponding to the plurality of subbands comprises determining a band alignment based on a correlation between a portion of the first frequency-domain signal and a portion of a globally shifted frequency-domain signal.

6. The method of claim 5, wherein determining the plurality of band alignments comprises sequentially shifting at least one of the portion of the first frequency-domain signal and the portion of the globally shifted frequency-domain signal.

7. The method of claim 6, wherein the sequential shifting is performed within a single rotation around a unit circle.

8. The method of claim 6, wherein a shift resolution is higher for a higher subband.

9. The method of claim 1, wherein the plurality of subbands includes one or more subbands with non-uniform bandwidths.

10. The method of claim 1, wherein transforming the prototype pitch period signal comprises determining a discrete-time Fourier series of the prototype pitch period signal or performing a discrete Fourier transform on the prototype pitch period signal.

11. The method of claim 10, wherein mapping the first frequency-domain signal is based on a length of the first frequency-domain signal.

12. An electronic device for quantizing phase information, comprising:

prototype pitch period extraction circuitry configured to determine a prototype pitch period signal based on a speech signal;

frequency domain transform circuitry coupled to the prototype pitch period extraction circuitry, wherein the frequency domain transform circuitry is configured to transform the prototype pitch period signal into a first frequency-domain signal;

amplitude transform circuitry coupled to the frequency domain transform circuitry, wherein the amplitude transform circuitry is configured to map the first frequency-domain signal into a plurality of subbands;

global alignment search circuitry coupled to the frequency domain transform circuitry, wherein the global alignment search circuitry is configured to determine a global alignment based on the first frequency-domain signal;

band alignment search circuitry coupled to the global alignment search circuitry, wherein the band alignment search circuitry is configured to determine a plurality of band alignments corresponding to the plurality of subbands;

global alignment quantizer circuitry coupled to the global alignment search circuitry, wherein the global alignment quantizer circuitry is configured to quantize the global alignment utilizing scalar quantization to obtain a quantized global alignment;

band alignments quantizer circuitry coupled to the band alignment search circuitry, wherein the band alignments quantizer circuitry is configured to quantize the plurality of band alignments utilizing vector quantization to obtain a quantized plurality of band alignments; and transmitter circuitry configured to transmit the quantized global alignment and the quantized plurality of band alignments.

13. The electronic device of claim 12, wherein the amplitude transform circuitry is configured to determine an amplitude for each of the plurality of subbands, and wherein the global alignment search circuitry is configured to determine a second frequency-domain signal based on an amplitude-quantized prototype pitch period signal, wherein a length of the second frequency-domain signal is equal to a length of the first frequency-domain signal, and wherein the global alignment search circuitry is configured to determine the global alignment based on a correlation between the first frequency-domain signal and the second frequency-domain signal.

14. The electronic device of claim 13, wherein the amplitude transform circuitry is configured to determine an average amplitude of at least one frequency index of the first frequency-domain signal within at least one of the plurality of subbands.

15. The electronic device of claim 14, wherein the average amplitude of a subband with two or more frequency indices is an average amplitude of first and last frequency indices in the subband.

16. The electronic device of claim 13, wherein the band alignment search circuitry is configured to determine a band alignment based on a correlation between a portion of the first frequency-domain signal and a portion of a globally shifted frequency-domain signal.

17. The electronic device of claim 16, wherein the band alignment search circuitry is configured to sequentially shift at least one of the portion of the first frequency-domain signal and the portion of the globally shifted frequency-domain signal.

18. The electronic device of claim 17, wherein the band alignment search circuitry is configured to perform sequential shifting within a single rotation around a unit circle.

19. The electronic device of claim 17, wherein a shift resolution is higher for a higher subband.

20. The electronic device of claim 12, wherein the plurality of subbands includes one or more subbands with non-uniform bandwidths.

21. The electronic device of claim 12, wherein the frequency domain transform circuitry is configured to determine a discrete-time Fourier series of the prototype pitch period signal or to perform a discrete Fourier transform on the prototype pitch period signal.

22. The electronic device of claim 21, wherein the amplitude transform circuitry is configured to map the first frequency-domain signal based on a length of the first frequency-domain signal.

23. A computer-program product for quantizing phase information, comprising a non-transitory tangible computer-readable medium having instructions thereon, the instructions comprising:

code for causing an electronic device to obtain a speech signal;

code for causing the electronic device to determine a prototype pitch period signal based on the speech signal;

code for causing the electronic device to transform the prototype pitch period signal into a first frequency-domain signal;

code for causing the electronic device to map the first frequency-domain signal into a plurality of subbands;

code for causing the electronic device to determine a global alignment based on the first frequency-domain signal;

code for causing the electronic device to quantize the global alignment utilizing scalar quantization to obtain a quantized global alignment;

code for causing the electronic device to determine a plurality of band alignments corresponding to the plurality of subbands;

code for causing the electronic device to quantize the plurality of band alignments utilizing vector quantization to obtain a quantized plurality of band alignments; and code for causing the electronic device to transmit the quantized global alignment and the quantized plurality of band alignments.

24. The computer-program product of claim 23, further comprising:

code for causing the electronic device to determine an amplitude for each of the plurality of subbands; and code for causing the electronic device to determine a second frequency-domain signal based on an amplitude-quantized prototype pitch period signal, wherein a length of the second frequency-domain signal is equal to a length of the first frequency-domain signal, and wherein determining the global alignment is based on a correlation between the first frequency-domain signal and the second frequency-domain signal.

25. The computer-program product of claim 24, wherein determining the amplitude for each of the plurality of subbands comprises determining an average amplitude of at least one frequency index of the first frequency-domain signal within at least one of the plurality of subbands.

26. The computer-program product of claim 25, wherein the average amplitude of a subband with two or more frequency indices is an average amplitude of first and last frequency indices in the subband.

27. The computer-program product of claim 24, wherein determining the plurality of band alignments corresponding to the plurality of subbands comprises determining a band alignment based on a correlation between a portion of the first frequency-domain signal and a portion of a globally shifted frequency-domain signal.

28. The computer-program product of claim 27, wherein determining the plurality of band alignments comprises sequentially shifting at least one of the portion of the first frequency-domain signal and the portion of the globally shifted frequency-domain signal.

29. The computer-program product of claim 28, wherein the sequential shifting is performed within a single rotation around a unit circle.

30. The computer-program product of claim 28, wherein a shift resolution is higher for a higher subband.

31. The computer-program product of claim 23, wherein the plurality of subbands includes one or more subbands with non-uniform bandwidths.

32. The computer-program product of claim 23, wherein transforming the prototype pitch period signal comprises determining a discrete-time Fourier series of the prototype pitch period signal or performing a discrete Fourier transform on the prototype pitch period signal.

33. The computer-program product of claim 32, wherein mapping the first frequency-domain signal is based on a length of the first frequency-domain signal.

34. An apparatus for quantizing phase information, comprising:

means for obtaining a speech signal;

means for determining a prototype pitch period signal based on the speech signal;

means for transforming the prototype pitch period signal into a first frequency-domain signal;

means for mapping the first frequency-domain signal into a plurality of subbands;

means for determining a global alignment based on the first frequency-domain signal;

means for quantizing the global alignment utilizing scalar quantization to obtain a quantized global alignment;

means for determining a plurality of band alignments corresponding to the plurality of subbands;

means for quantizing the plurality of band alignments utilizing vector quantization to obtain a quantized plurality of band alignments; and means for transmitting the quantized global alignment and the quantized plurality of band alignments.

35. The apparatus of claim 34, further comprising:

means for determining an amplitude for each of the plurality of subbands; and means for determining a second frequency-domain signal based on an amplitude-quantized prototype pitch period signal, wherein a length of the second frequency-domain signal is equal to a length of the first frequency-domain signal, and wherein determining the global alignment is based on a correlation between the first frequency-domain signal and the second frequency-domain signal.

36. The apparatus of claim 35, wherein determining the amplitude for each of the plurality of subbands comprises determining an average amplitude of at least one frequency index of the first frequency-domain signal within at least one of the plurality of subbands.

37. The apparatus of claim 36, wherein the average amplitude of a subband with two or more frequency indices is an average amplitude of first and last frequency indices in the subband.

38. The apparatus of claim 35, wherein determining the plurality of band alignments corresponding to the plurality of subbands comprises determining a band alignment based on a correlation between a portion of the first frequency-domain signal and a portion of a globally shifted frequency-domain signal.

39. The apparatus of claim 38, wherein determining the plurality of band alignments comprises sequentially shifting at least one of the portion of the first frequency-domain signal and the portion of the globally shifted frequency-domain signal.

40. The apparatus of claim 39, wherein the sequential shifting is performed within a single rotation around a unit circle.

41. The apparatus of claim 39, wherein a shift resolution is higher for a higher subband.

42. The apparatus of claim 34, wherein the plurality of subbands includes one or more subbands with non-uniform bandwidths.

43. The apparatus of claim 34, wherein transforming the prototype pitch period signal comprises determining a discrete-time Fourier series of the prototype pitch period signal or performing a discrete Fourier transform on the prototype pitch period signal.

44. The apparatus of claim 43, wherein mapping the first frequency-domain signal is based on a length of the first frequency-domain signal.

* * * * *